US009208765B1

(12) United States Patent
Sivertsen

(10) Patent No.: US 9,208,765 B1
(45) Date of Patent: Dec. 8, 2015

(54) AUDIO VISUAL PRESENTATION WITH THREE-DIMENSIONAL DISPLAY DEVICES

(71) Applicant: AMERICAN MEGATRENDS, INC., Norcross, GA (US)

(72) Inventor: Clas Gerhard Sivertsen, Lilburn, GA (US)

(73) Assignee: AMERICAN MEGATRENDS, INC., Norcross, GA (US)

( * ) Notice: Subject to any disclaimer, the term of this patent is extended or adjusted under 35 U.S.C. 154(b) by 113 days.

(21) Appl. No.: 14/029,937

(22) Filed: Sep. 18, 2013

(51) Int. Cl.
*G10H 5/00* (2006.01)

(52) U.S. Cl.
CPC ..... *G10H 5/00* (2013.01)

(58) Field of Classification Search
CPC ..... G10H 5/00; G10H 1/0091; G06F 3/042; G06F 3/0421; G06F 3/0425; G06F 3/0428; G06F 3/048; G06F 2203/04808; G09G 3/003
USPC ..... 345/32, 156, 173; 348/42, 51
See application file for complete search history.

(56) References Cited

U.S. PATENT DOCUMENTS

| | | | | |
|---|---|---|---|---|
| 6,064,354 | A | 5/2000 | DeLuca | |
| 6,882,337 | B2 * | 4/2005 | Shetter | 345/173 |
| 8,253,713 | B2 * | 8/2012 | Soo et al. | 345/175 |
| 2006/0092170 | A1 * | 5/2006 | Bathiche et al. | 345/589 |
| 2008/0029316 | A1 * | 2/2008 | Jaeger et al. | 178/19.01 |
| 2008/0096651 | A1 * | 4/2008 | Okada | 463/31 |
| 2010/0261526 | A1 | 10/2010 | Anderson | |
| 2011/0012841 | A1 * | 1/2011 | Lin | 345/173 |
| 2011/0084893 | A1 * | 4/2011 | Lee et al. | 345/6 |
| 2011/0234502 | A1 | 9/2011 | Yun | |
| 2012/0019528 | A1 | 1/2012 | Ugawa | |
| 2012/0131453 | A1 | 5/2012 | Pechanec | |
| 2012/0147000 | A1 | 6/2012 | Song | |
| 2012/0194512 | A1 | 8/2012 | Kim | |
| 2012/0256823 | A1 * | 10/2012 | Lee et al. | 345/156 |
| 2012/0256854 | A1 * | 10/2012 | Lee et al. | 345/173 |
| 2012/0256886 | A1 * | 10/2012 | Ryu et al. | 345/204 |
| 2013/0033440 | A1 * | 2/2013 | Cheng et al. | 345/173 |
| 2013/0050202 | A1 * | 2/2013 | Ueno et al. | 345/419 |
| 2013/0293534 | A1 * | 11/2013 | Sato et al. | 345/419 |
| 2013/0335648 | A1 * | 12/2013 | Kuroda | 349/15 |
| 2014/0111448 | A1 * | 4/2014 | Moses et al. | 345/173 |

* cited by examiner

*Primary Examiner* — Tom Sheng
(74) *Attorney, Agent, or Firm* — Locke Lord LLP; Tim Tingkang Xia, Esq.

(57) ABSTRACT

Certain aspects of the present disclosure relate to an audio visual display device, which includes a transparent display module, a sensing module, and a controller. The sensing module generates sensing signals in response to detecting an object at a disc jockey side of the transparent display module. The controller includes stores computer executable codes which, when executed at a processor, are configured to: generate display signals for the transparent display module to control its pixels to display an image corresponding to the display signals; receive the sensing signals from the sensing module, and generate an object coordinate according to the sensing signals; in response to an audio visual display instruction, generate the display signals corresponding to a virtual disc jockey equipment; and in response to the object coordinate matching coordinates of the virtual disc jockey equipment, generate an audio effect command for the virtual disc jockey equipment.

25 Claims, 17 Drawing Sheets

AUDIO VISUAL PRESENTATION WITH THREE-DIMENSIONAL DISPLAY DEVICES

FIELD

The present disclosure generally relates to audio visual presentation with three-dimensional display devices, and more particularly to performing audio visual presentation using three-dimensional display devices being capable of displaying three-dimensional graphic objects.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

A disc jockey, also known as DJ, is a person who plays recorded music for an audience. The disc jockey concept has evolved from playing music from the record to a variety of different types. For example, a club DJ selects and plays music in bars, nightclubs, disco pubs, at parties or raves, or even in stadiums. A hip-hop DJ may select and play music using multiple turntables to back up one or more rappers, and perform turntable scratching to create percussive sounds. In certain occasions, the DJ may be a music producer, using turntables and sampling to create backing instrumentals for new tracks. Generally, DJ equipment may include, among other things, sound systems, sound recording equipment, audio mixers, electronic effects units and midi controllers.

Traditionally, in playing music or performing scratching, a DJ faces down on a table where the equipment is placed. The audience cannot see the DJ equipment or the DJ performing scratching techniques. Similarly, the DJ has to look up from the equipment to observe the reaction of the audience. There is a need for a new DJ equipment to allow the DJ and the audience to better observe each other.

Therefore, heretofore unaddressed needs still exist in the art to address the aforementioned deficiencies and inadequacies.

SUMMARY

Certain aspects of the present disclosure relate to an audio visual display device. In certain embodiments, the audio visual display device includes: a transparent display module defining a plurality of pixels in a pixel matrix; a sensing module configured to detect an object at a disc jockey (DJ) side of the transparent display module, and to generate a plurality of sensing signals in response to detecting the object; and a controller electrically connected to the transparent display module and the sensing module. The controller includes a processor and a non-volatile memory storing computer executable codes. The codes, when executed at the processor, are configured to: generate display signals, and send the display signals to the transparent display module to control the pixels to display an image corresponding to the display signals; receive the sensing signals from the sensing module, and generate an object coordinate according to the sensing signals; in response to an audio visual display instruction, generate the display signals corresponding to a virtual disc jockey equipment; and in response to the object coordinate matching coordinates of the virtual disc jockey equipment, generate an audio effect command for the virtual disc jockey equipment.

In certain embodiments, the audio visual display device further includes a barrier module disposed at the DJ side of the transparent display module. For a DJ at the DJ side, the barrier module is configured to allow light emitted from a first set of the pixels to be viewable only by a left eye of the DJ, and allow light emitted from a second set of the pixels to be viewable only by a right eye of the DJ, such that the DJ perceives the light emitted from the first set of the pixels as a left-eye view and the light emitted from the second set of the pixels as a right-eye view, and perceives the left-eye view and the right view to form a three-dimensional virtual image between the DJ and the transparent display module.

In certain embodiments, the barrier module is a parallax barrier layer, comprising a plurality of transparent units and a plurality of opaque units alternatively positioned.

In certain embodiments, the audio visual display device is switchable between a two-dimensional display mode and a three-dimensional display mode.

In certain embodiments, the codes include: a pixel control module configured to generate the display signals in response to a plurality of image signals, and send the display signals respectively to the display module to control the pixels; an image processing module configured to generate the image signals from the image; and a sensing control module configured to generate scan signals for the sensing module, receive the sensing signals from the sensing module, and generate the object coordinate by comparing the sensing signals.

In certain embodiments, the sensing module includes a plurality of capacitive sensing units in a capacitive matrix. Each of the capacitive sensing units is configured to receive one of the scan signals generated by the sensing control module, to generate the sensing signals in response to the scan signal, and to send the sensing signals to the sensing control module.

In certain embodiments, the capacitive sensing units are capacitive sensor electrodes, and each of the capacitive sensor electrodes is configured to induce a capacitance change when the object exists within a predetermined range of the capacitive sensor electrode.

In certain embodiments, the capacitive sensing units are capacitive micromachined ultrasonic transducer (CMUT) arrays, and each of the CMUT arrays comprises a plurality of CMUT units, wherein each of the CMUT arrays is configured to transmit ultrasonic waves and to receive refracted ultrasonic waves by the objects.

In certain embodiments, the display signals include a plurality of scan signals and a plurality of data signals.

In certain embodiments, the transparent display module includes: a scan driver electrically connected to the controller, configured to receive the scan signals from the controller; a data driver electrically connected to the controller, configured to receive the data signals from the controller; a plurality of scan lines electrically connected to the scan driver, each scan line configured to receive one of the scan signals from the scan driver; and a plurality of data lines electrically connected to the data driver, each data line configured to receive one of the data signals from the data driver. The scan lines and the data lines cross over to define the plurality of pixels.

Certain aspects of the present disclosure relate to a controller, which includes a processor and a non-volatile memory storing computer executable codes. The codes, when executed at the processor, are configured to: generate display signals for a transparent display module defining a plurality of pixels in a pixel matrix, and send the display signals to the transparent display module to control the pixels to display an image corresponding to the display signals; receive sensing signals from a sensing module, and generate an object coordinate according to the sensing signals, wherein the sensing module is configured to detect an object at a disc jockey (DJ) side of the transparent display module, and to generate the sensing signals in response to detecting the object; in response to an audio visual display instruction, generate the display signals corresponding to a virtual disc jockey equipment; and in response to the object coordinate matching coordinates of the virtual disc jockey equipment, generate an audio effect command for the virtual disc jockey equipment.

In certain embodiments, a barrier module is disposed at the DJ side of the transparent display module. For a DJ at the DJ side, the barrier module is configured to allow light emitted from a first set of the pixels to be viewable only by a left eye of the DJ, and allow light emitted from a second set of the pixels to be viewable only by a right eye of the DJ, such that the DJ perceives the light emitted from the first set of the pixels as a left-eye view and the light emitted from the second set of the pixels as a right-eye view, and perceives the left-eye view and the right view to form a three-dimensional virtual image between the DJ and the transparent display module.

In certain embodiments, the barrier module is a parallax barrier layer, comprising a plurality of transparent units and a plurality of opaque units alternatively positioned.

In certain embodiments, the transparent display module is switchable between a two-dimensional display mode and a three-dimensional display mode.

In certain embodiments, the codes include: a pixel control module configured to generate the display signals in response to a plurality of image signals, and send the display signals respectively to the display module to control the pixels; an image processing module configured to generate the image signals from the image; and a sensing control module configured to generate scan signals for the sensing module, receive the sensing signals from the sensing module, and generate the object coordinate by comparing the sensing signals.

In certain embodiments, the sensing module includes a plurality of capacitive sensing units in a capacitive matrix. Each of the capacitive sensing units is configured to receive one of the scan signals generated by the sensing control module, to generate the sensing signals in response to the scan signal, and to send the sensing signals to the sensing control module.

In certain embodiments, the capacitive sensing units are capacitive sensor electrodes, and each of the capacitive sensor electrodes is configured to induce a capacitance change when the object exists within a predetermined range of the capacitive sensor electrode.

In certain embodiments, the capacitive sensing units are capacitive micromachined ultrasonic transducer (CMUT) arrays, and each of the CMUT arrays comprises a plurality of CMUT units, wherein each of the CMUT arrays is configured to transmit ultrasonic waves and to receive refracted ultrasonic waves by the objects.

Certain aspects of the present disclosure relate to a non-transitory computer readable medium storing computer executable codes. The codes, when executed at the processor, are configured to: generate display signals for a transparent display module defining a plurality of pixels in a pixel matrix, and send the display signals to the transparent display module to control the pixels to display an image corresponding to the display signals; receive sensing signals from a sensing module, and generate an object coordinate according to the sensing signals, wherein the sensing module is configured to detect an object at a disc jockey (DJ) side of the transparent display module, and to generate the sensing signals in response to detecting the object; in response to an audio visual display instruction, generate the display signals corresponding to a virtual disc jockey equipment; and in response to the object coordinate matching coordinates of the virtual disc jockey equipment, generate an audio effect command for the virtual disc jockey equipment.

In certain embodiments, a barrier module is disposed at the DJ side of the transparent display module. For a DJ at the DJ side, the barrier module is configured to allow light emitted from a first set of the pixels to be viewable only by a left eye of the DJ, and allow light emitted from a second set of the pixels to be viewable only by a right eye of the DJ, such that the DJ perceives the light emitted from the first set of the pixels as a left-eye view and the light emitted from the second set of the pixels as a right-eye view, and perceives the left-eye view and the right view to form a three-dimensional virtual image between the DJ and the transparent display module.

In certain embodiments, the transparent display module is switchable between a two-dimensional display mode and a three-dimensional display mode.

In certain embodiments, the codes include: a pixel control module configured to generate the display signals in response to a plurality of image signals, and send the display signals respectively to the display module to control the pixels; an image processing module configured to generate the image signals from the image; and a sensing control module configured to generate scan signals for the sensing module, receive the sensing signals from the sensing module, and generate the object coordinate by comparing the sensing signals.

In certain embodiments, the sensing module includes a plurality of capacitive sensing units in a capacitive matrix. Each of the capacitive sensing units is configured to receive one of the scan signals generated by the sensing control module, to generate the sensing signals in response to the scan signal, and to send the sensing signals to the sensing control module.

In certain embodiments, the capacitive sensing units are capacitive sensor electrodes, and each of the capacitive sensor electrodes is configured to induce a capacitance change when the object exists within a predetermined range of the capacitive sensor electrode.

In certain embodiments, the capacitive sensing units are capacitive micromachined ultrasonic transducer (CMUT) arrays, and each of the CMUT arrays comprises a plurality of CMUT units, wherein each of the CMUT arrays is configured to transmit ultrasonic waves and to receive refracted ultrasonic waves by the objects.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1A:
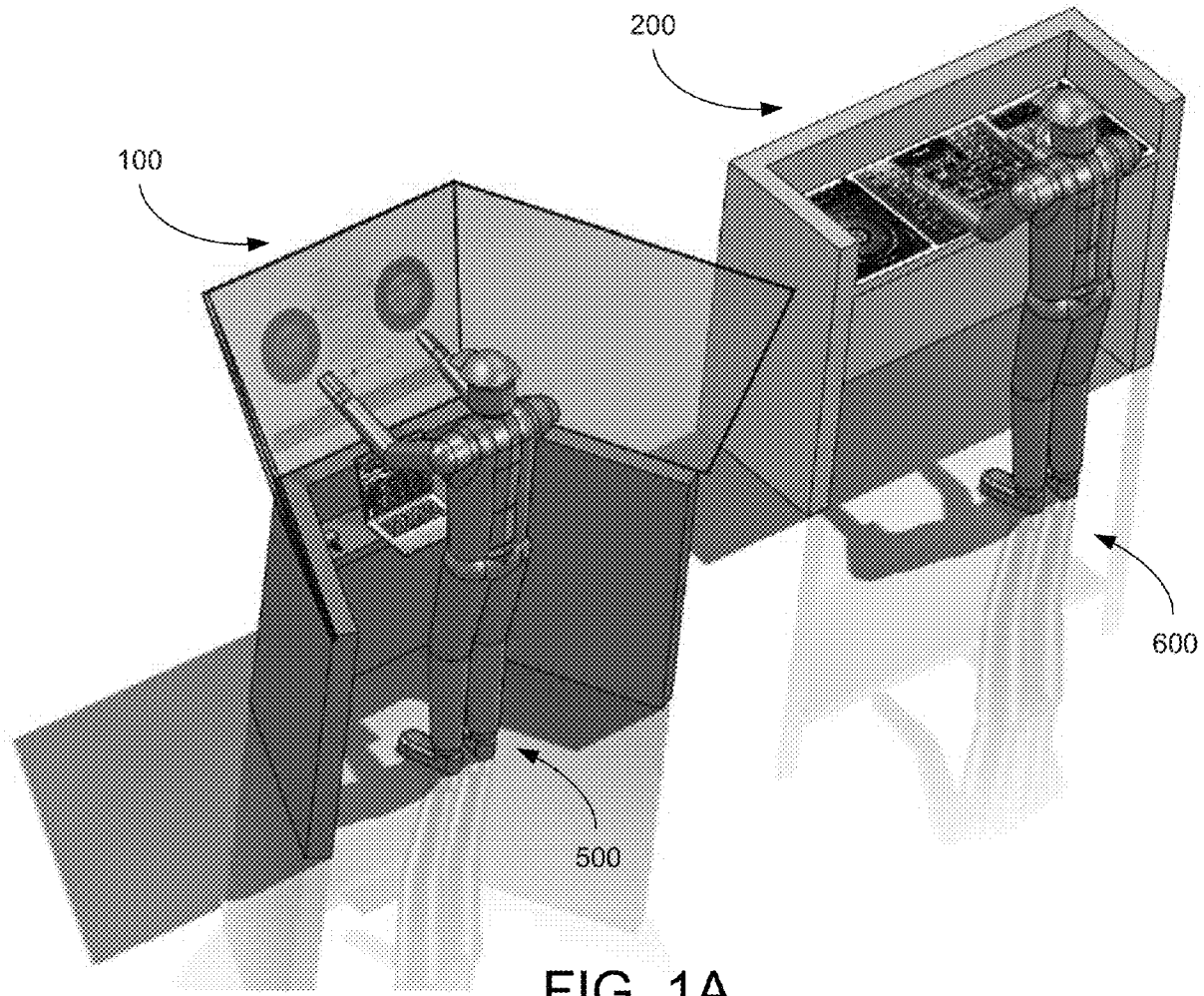
FIGS. 1A and 1B schematically depict traditional DJ equipment and an audio visual display device according to one embodiment of the present disclosure.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data.

Non-limiting examples of the non-transitory tangible computer readable medium are nonvolatile memory, magnetic storage, and optical storage.

The present disclosure will now be described more fully hereinafter with reference to the accompanying drawings, in which embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout.

Figure 1B:
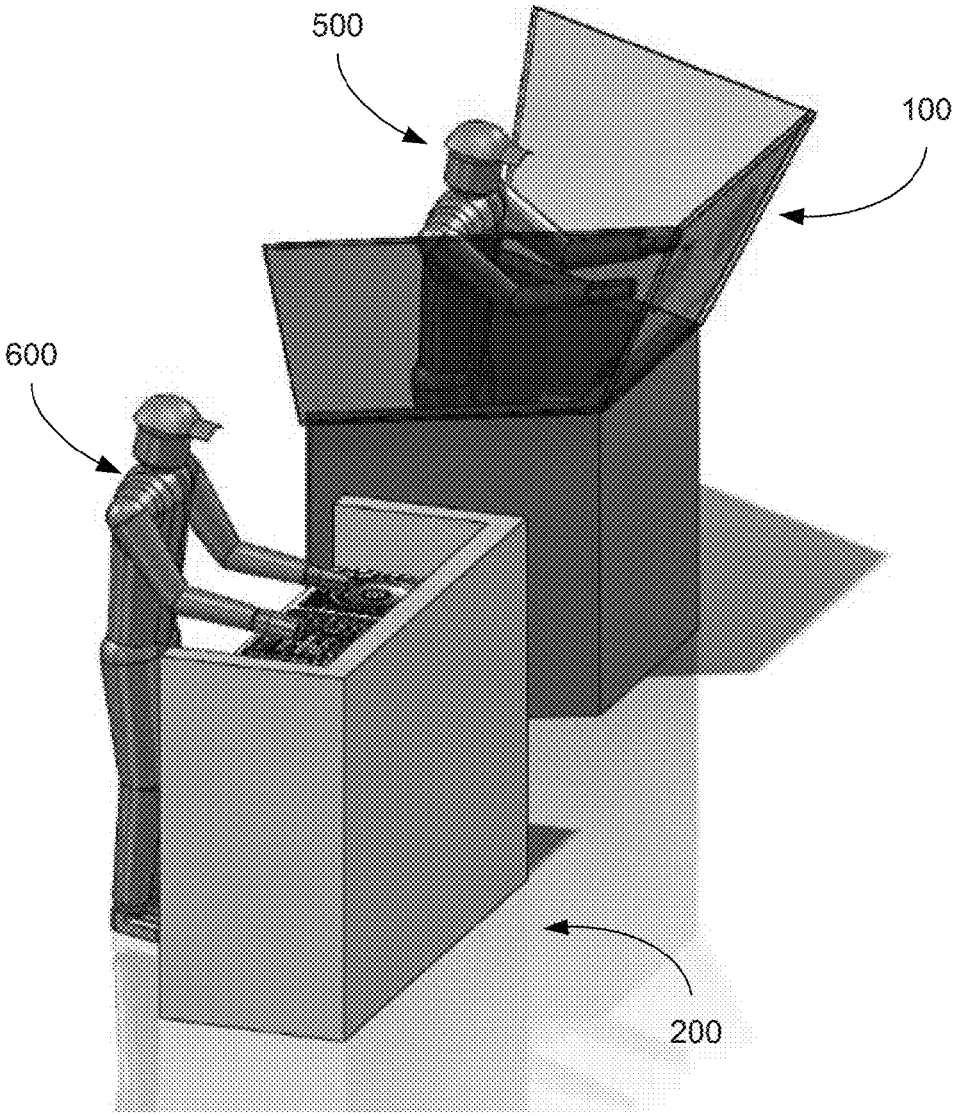

FIGS. 1A and 1B schematically depict traditional DJ equipment and an audio visual display device according to one embodiment of the present disclosure. In certain embodiments, the audio visual display device 100 as shown in FIGS. 1A and 1B is a multi-surface three-dimensional transparent display device. As shown in FIGS. 1A and 1B, a DJ 600 using traditional DJ equipment 200 has to put the equipment on a table and look down on the equipment. In contrast, a DJ 500 using the audio visual display device 100 may face the audience and perform on a virtual equipment shown on the audio visual display device 100. Thus, the DJ 500 may observe the audience reaction while operating the virtual equipment.

Figure 1C:
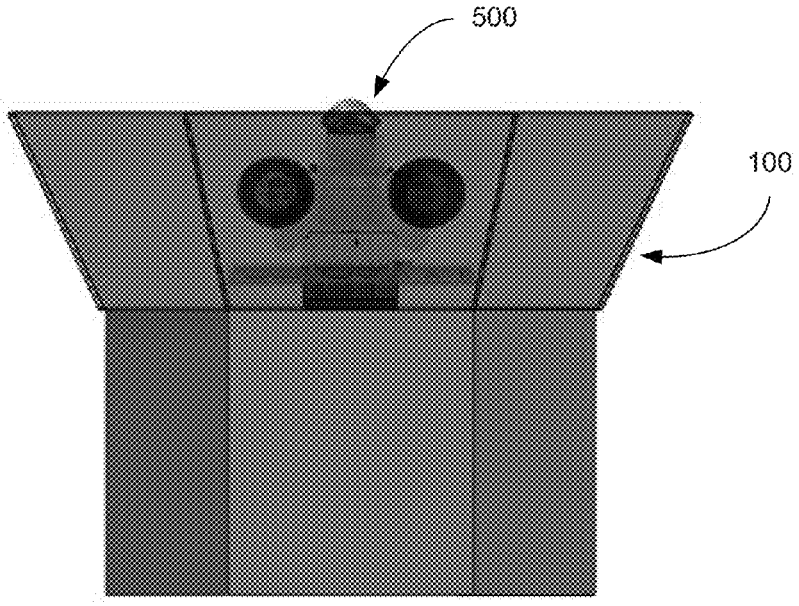
FIG. 1C schematically depicts the audio visual display device viewed from audience side according to one embodiment of the present disclosure.

FIG. 1C schematically depicts the audio visual display device viewed from audience side according to one embodiment of the present disclosure. As shown in FIG. 1C, the audio visual display device 100 is transparent or semi-transparent, and the audience may see the DJ 500 from audience side through the audio visual display device 100.

Figure 1D:
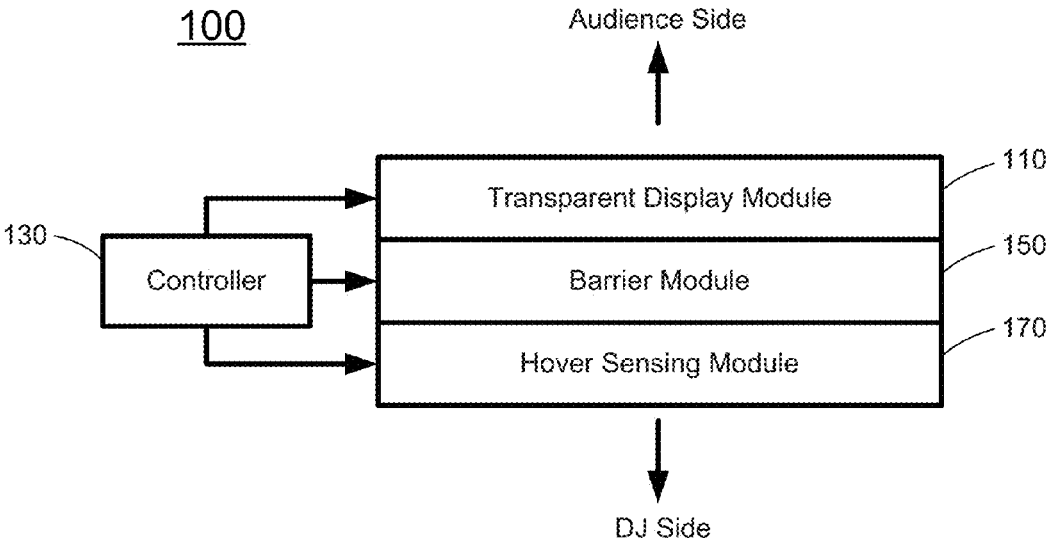
FIG. 1D schematically depicts the audio visual display device according to one embodiment of the present disclosure.

FIG. 1D schematically depicts the audio visual display device according to one embodiment of the present disclosure. In certain embodiments, the audio visual display device 100 may be a touch screen display panel having the capability of displaying three-dimensional images and sensing the touching and hovering actions. In certain embodiments, the audio visual display device 100 may be a display device connected to an electronic device, such as a digital television, a computer, a laptop, a smartphone, a tablet, or any other types of electronic devices.

As shown in FIG. 1D, the audio visual display device 100 includes a transparent display module 110, a controller 130, a barrier module 150, and a hover sensing module 170. In certain embodiments, the transparent display module 110, the barrier module 150 and the hover sensing module 170 are at least partially transparent or semi-transparent. The barrier module 150 and the hover sensing module 170 are disposed at the DJ side of the transparent display module 110. The controller 130 is electrically connected to the transparent display module 110, the barrier module 150 and the hover sensing module 170, respectively. In certain embodiments, the audio visual display device 100 is an in-cell hover sensing display device, where the transparent display module 110, the barrier module 150 and the hover sensing module 170 may be integrated into one panel instead of stacking up in separate layers. In certain embodiments, the transparent display module 110, the barrier module 150 and the hover sensing module 170 may be separate layers, and are respectively attached together to form a layered structure. Although not explicitly shown in FIG. 1D, the audio visual display device 100 may include other peripheral devices or structures. For example, the audio visual display device 100 may include one or more protective layer to prevent the transparent display module 110, the barrier module 150 and the hover sensing module 170 from scratching, glare and reflections.

The transparent display module 110 is an image display panel of the audio visual display device 100, which is capable of displaying images. In certain embodiments, the transparent display module 110 can be any type of transparent display panels, such as liquid crystal displays (LCDs), light emitting diodes (LEDs), plasma displays, projector displays, or any other types of displays. In certain embodiments, the transparent display module 110 may be a two-dimensional display panel, which does not have three-dimensional display capability. In certain embodiments, the transparent display module 110 can be a color display which adopts a color model. For example, the transparent display module 110 may adopt the RGB color model, which is configured to display a broad array of colors by mixing the three primary colors of red (R), green (G) and blue (B).

Figure 2A:
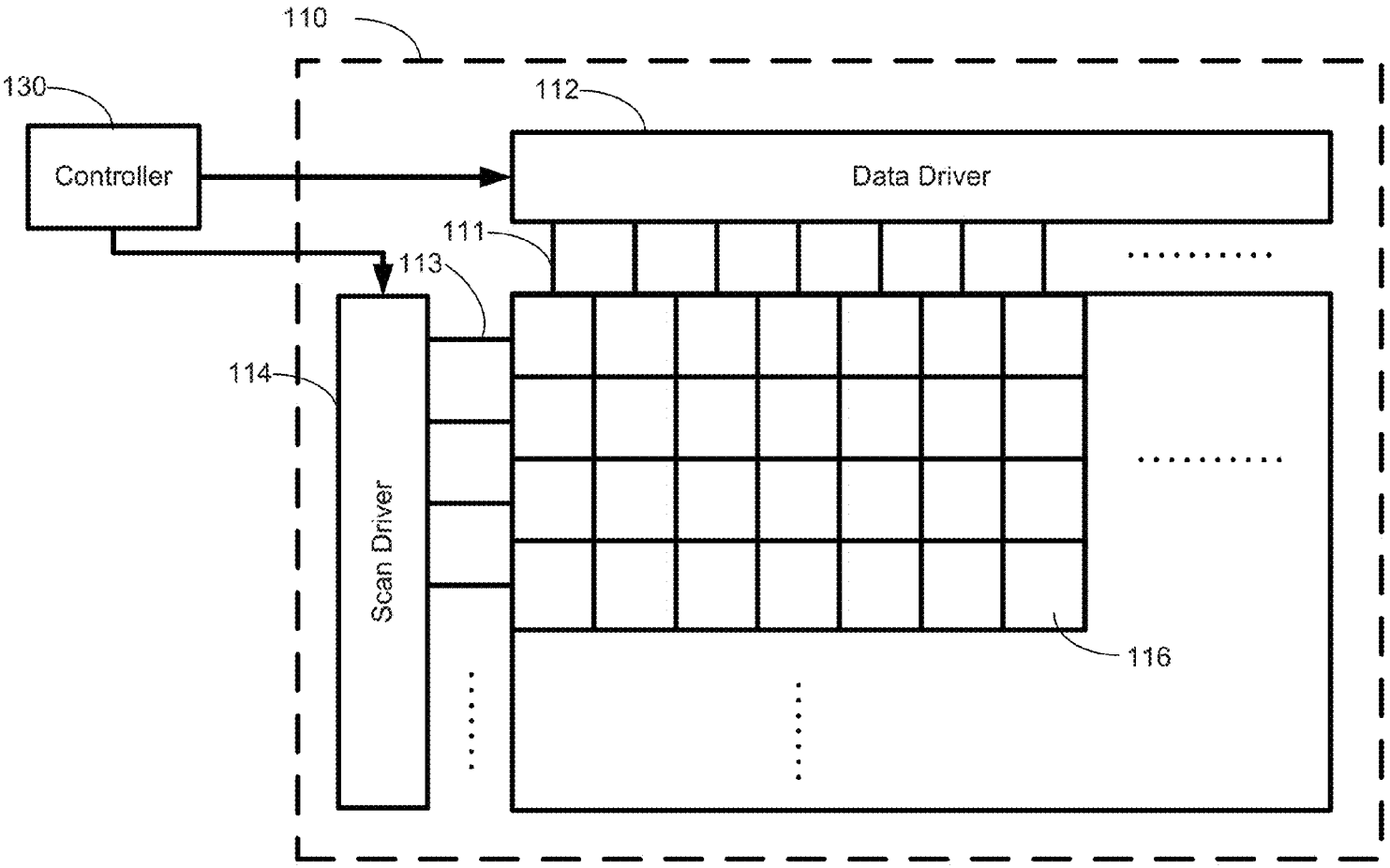
FIG. 2A schematically depicts a transparent display module according to one embodiment of the present disclosure.

FIG. 2A schematically depicts a transparent display module according to one embodiment of the present disclosure. As shown in FIG. 2A, the transparent display module 110 includes a data driver 112 and a scan driver 114 respectively connected to the controller 130 to receive data signals and scan signals. Further, a plurality of pixels 116 is defined on the transparent display module 110 to form a pixel matrix. The data driver 112 is electrically connected to a plurality of data lines 111 to transmit the data signals to each of the pixels 116, and the scan driver 114 is electrically connected to a plurality of scan lines 113 to transmit the scan signals to each of the pixels 116. In other words, each pixel 116 is electrically connected to at least one data line 111 and at least one scan line 113. In certain embodiments, the pixel matrix may be formed by light-emitting elements (e.g., LED panels) without the need of using a backlight module. In certain embodiments, the transparent display module 110 may include the backlight module as the light source for non-emitting pixel matrix (e.g., LCD panels).

Figure 2B:
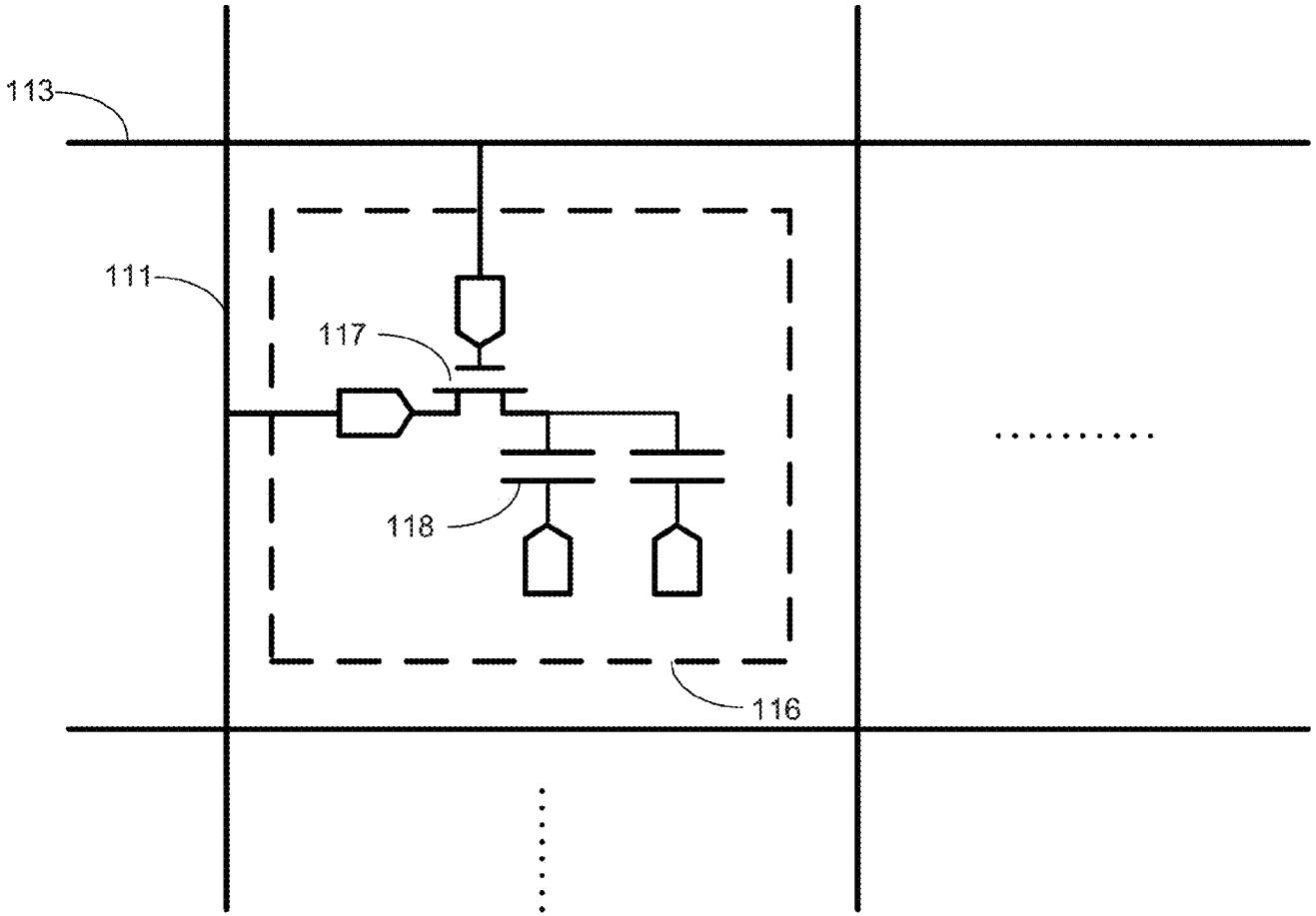
FIG. 2B schematically depicts a pixel according to one embodiment of the present disclosure.

FIG. 2B schematically depicts a pixel according to one embodiment of the present disclosure. As shown in FIG. 2B, a pixel 116 includes a pixel circuit, which is formed by a plurality of electronic elements, such as one or more thin-film transistors (TFTs) 117 and one or more capacitors 118. Interconnection of the electronic elements may vary according to different requirements of the pixel circuit. In certain embodiments, the TFT 117 serves as a switch. The source of the TFT 117 is connected to the data line 111 to receive the data signal, which controls the display of the pixel 116. The gate of the TFT 117 is connected to the scan line 113 to receive the scan signal, which controls the switch of the TFT 117. In certain embodiments, when the scan signal is at a high voltage level, the scan signal turns on the switch of the TFT 117 such that the data signal is transmittable from the source of the TFT 117 to the drain of the TFT 117. On the other hand, when the scan signal is at a low voltage level, the scan signal turns off the switch of the TFT 117, and the data signal is not transmittable to the drain of the TFT 117. Thus, by modulating the scan signals and the data signals, each pixel 116 may receive the corresponding data signal for displaying.

The barrier module 150 is a three-dimensional enabler layer for providing three-dimensional display capability for the transparent display module 110. In certain embodiments, the barrier module 150 is a barrier film layer attached on the transparent display module 110. To display three-dimensional images, the barrier module 150 is disposed at a DJ side of the transparent display module 110, as shown in FIG. 1D. Thus, the barrier module 150 is positioned between the transparent display module 110 and the viewer, and the light emitted by the transparent display module 110 passes through the barrier module 150 to reach the eyes of the DJ 500.

The implementation of the three-dimensional display capability relates to the stereopsis impression of human eyes. The term "stereopsis" refers to three-dimensional appearances or sights. As human eyes are in different horizontal positions on the head, they present different views simultaneously. When both eyes simultaneously see an object within the sight, the two eyes perceive the two different views or images of the object along two non-parallel lines of sight. The human brain then processes with the two different views received by the two eyes to gain depth perception and estimate distances to the object.

Using the stereopsis concept, the barrier module 150 may be positioned to partially block or to refract light emitted from the pixels 116 of the transparent display module 110, allowing each eye of a viewer (e.g. the DJ 500) to see the light emitted from a different set of pixels 116 of the transparent display module 110. In other words, the viewer sees a left-eye view displayed by one set of pixels 116 by the left eye, and a right-eye view displayed by the other set of pixels 116 by the right eye. For example, for a pixel row, the left eye L receives the left-eye view only from the pixels 116 with odd numbers, and the right eye receives the right-eye view only from the pixels 116 with even numbers. When the left-eye view and the right-eye view are two offset images to correspondingly form a stereoscopic image, the brain of the viewer perceives the two offset images with the sense of depth, creating an illusion of the three-dimensional scene of the stereoscopic image. More precisely, the viewer "sees" the stereoscopic image as a virtual object since there is no actual object existing at the perceived location. Since the pixels 116 are divided into two sets to show the two offset images for the stereoscopic image, the resolution of the stereoscopic image is one half of the resolution of the transparent display module 110.

In certain embodiments, the barrier module 150 may have a parallax structure. The parallax barrier module is a panel having a series of precision slits or transparent regions. By setting the positions of the precision slits or transparent regions, the parallax barrier module allows the two eyes of the viewer to respectively see the different sets of the pixels 116.

Figure 3A:
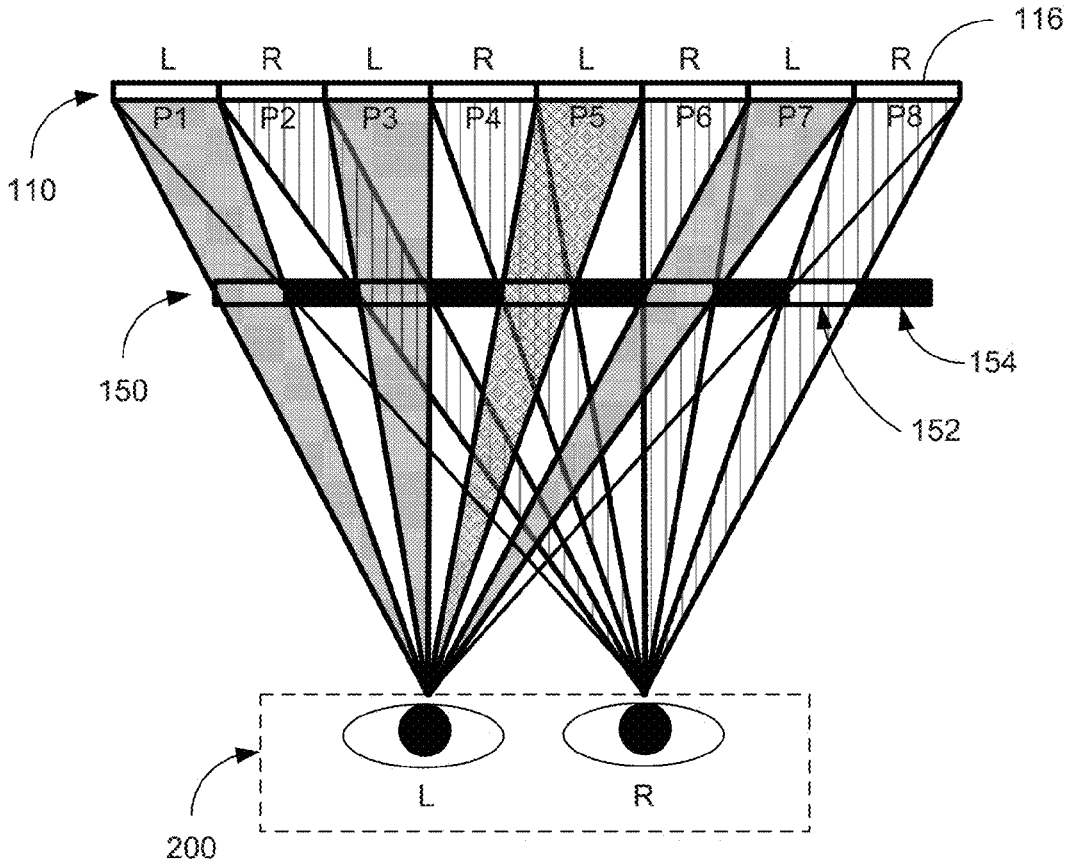
FIG. 3A schematically depicts a three-dimensional display device having a parallax barrier module according to one embodiment of the present disclosure.

FIG. 3A schematically depicts a three-dimensional display device having a parallax barrier module according to one embodiment of the present disclosure. As shown in FIG. 3A, the barrier module 150 has a plurality of barrier units, including transparent units 152 (shown as white blocks) and opaque units 154 (shown as black blocks) alternative positioned along a horizontal direction, which is parallel to the human eye alignment direction. Light emitted from the pixels 116 of the transparent display module 110 may only pass through the transparent units 152 and not through the opaque units 154. Thus, the distance between the barrier module 150 and the transparent display module 110 and the relative pitch size of the transparent regions 152 to the pixels 116 determine an optimum viewable zone 200 for the three-dimensional audio visual display device 100. For example, a viewer within the optimum viewable zone 200 may see one set of pixels 116 (P1, P3, P5, P7, etc.) with the left eye L, and the other set of pixels 116 (P2, P4, P6, P8, etc.) with the right eye R. In other words, the left eye L receives only the image signals corresponding to the pixels 116 with odd numbers (P1, P3, P5, P7 . . . ), and the right eye receives only the image signals corresponding to the pixels 116 with even numbers (P2, P4, P6, P8 . . . ).

In certain embodiments, the parallax barrier module 150 may be switchable between two-dimensional and three-dimensional display modes. For example, the opaque units 154 may be switchable between a transparent state and an opaque state. When the opaque units 154 are in the opaque state, a viewer may only see through the transparent units 152 and not through the opaque units 154, allowing the audio visual display device 100 to display three-dimensional images. On the other hand, when the opaque units 154 are switched to the transparent state, all barrier units of the barrier module 150 are transparent as if the barrier module 150 had not existed, and the viewer may see all the pixels 116 of the transparent display module 110 with both eyes. In this case, the audio visual display device 100 may display two-dimensional images.

In certain embodiments, the barrier module 150 may have a lenticular structure. The lenticular barrier module is a panel having a series of lens. By setting the positions and curvatures of the lens, the lenticular barrier module allows the light emitted from the different sets of the pixels 116 to refract toward the two eyes of the viewer respectively, such that each eye sees one set of the pixels 116.

Figure 3B:
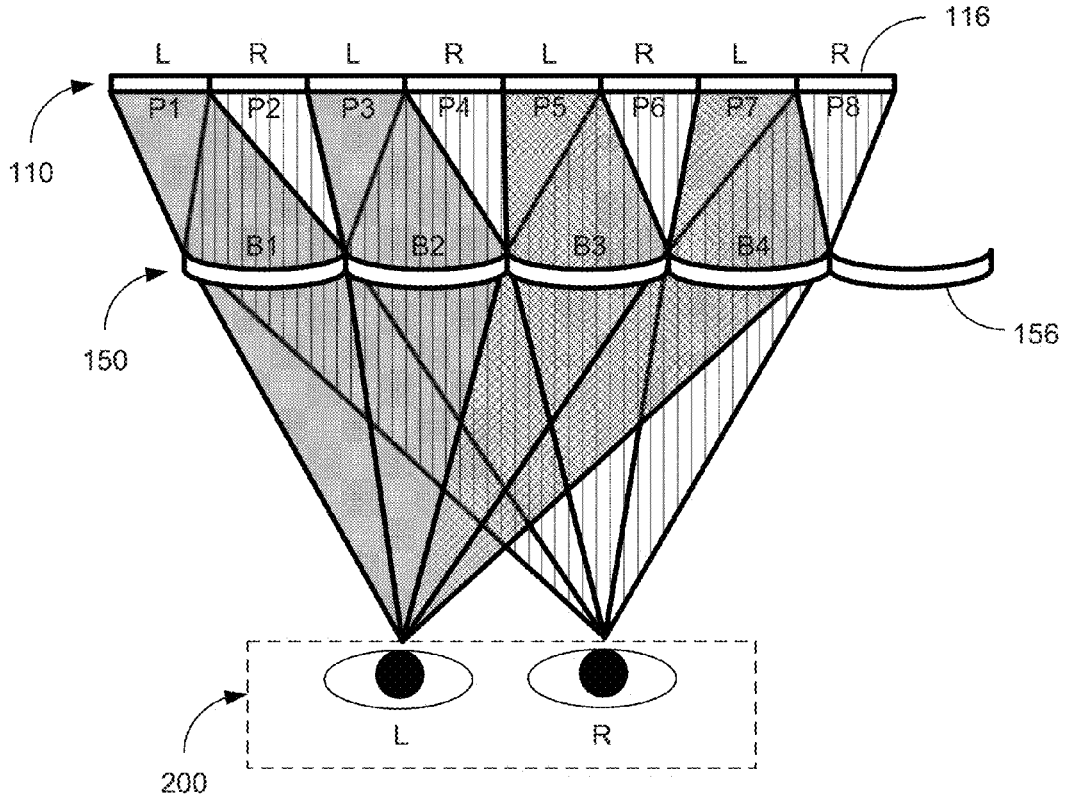
FIG. 3B schematically depicts a three-dimensional display device having a lenticular barrier module according to one embodiment of the present disclosure.

FIG. 3B schematically depicts a three-dimensional display device having a lenticular barrier module according to one embodiment of the present disclosure. As shown in FIG. 3B, the barrier module 150 has a plurality of lens units 156 positioned along the horizontal direction. Light emitted from the pixels 116 of the transparent display module 110 may pass through and be refracted by each lens unit 156. Thus, the curvature of the lens units 156 and the relative size of the lens units 156 to the pixels 116 determine an optimum viewable zone 200 for the three-dimensional audio visual display device 100. For example, a viewer within the optimum viewable zone 200 may see one set of pixels 116 (P1, P3, P5, P7, etc.) with the left eye L, and the other set of pixels 116 (P2, P4, P6, P8, etc.) with the right eye R. In other words, the left eye L receives only the image signals corresponding to the pixels 116 with odd numbers (P1, P3, P5, P7 . . . ), and the right eye receives only the image signals corresponding to the pixels 116 with even numbers (P2, P4, P6, P8 . . . ).

As described above, when the viewer receives, with both eyes, two offset images to correspondingly form a stereoscopic image, the brain of the viewer perceives the two offset images with the sense of depth to create the illusion of a virtual object. The perception of depth relates to the offset distance of the two offset images. By increasing the offset distance of the two offset images, the brain perceives a decreased depth of the virtual object.

Figure 4A:
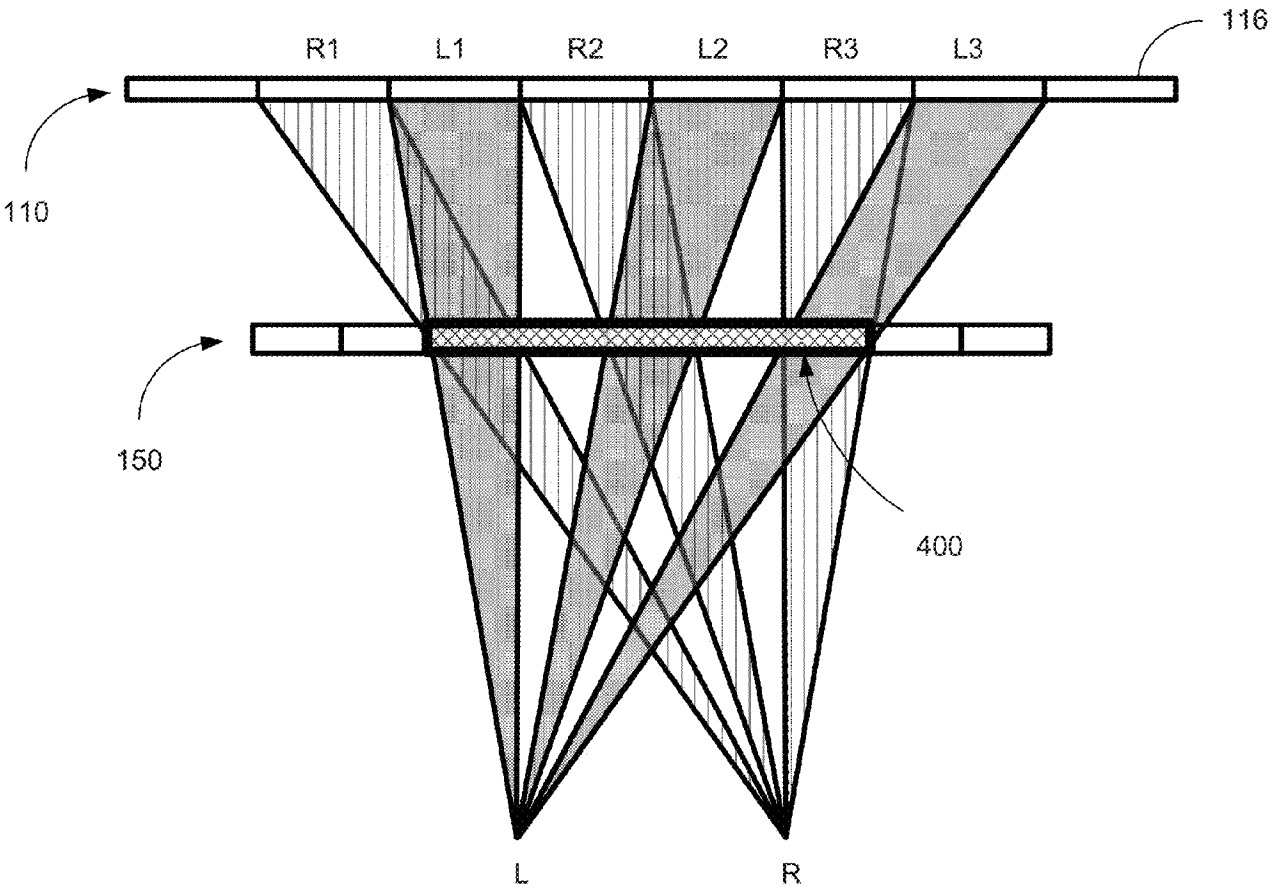
FIG. 4A schematically depicts depth perception of a virtual object with one-pixel offset according to one embodiment of the present disclosure.
Figure 4B:
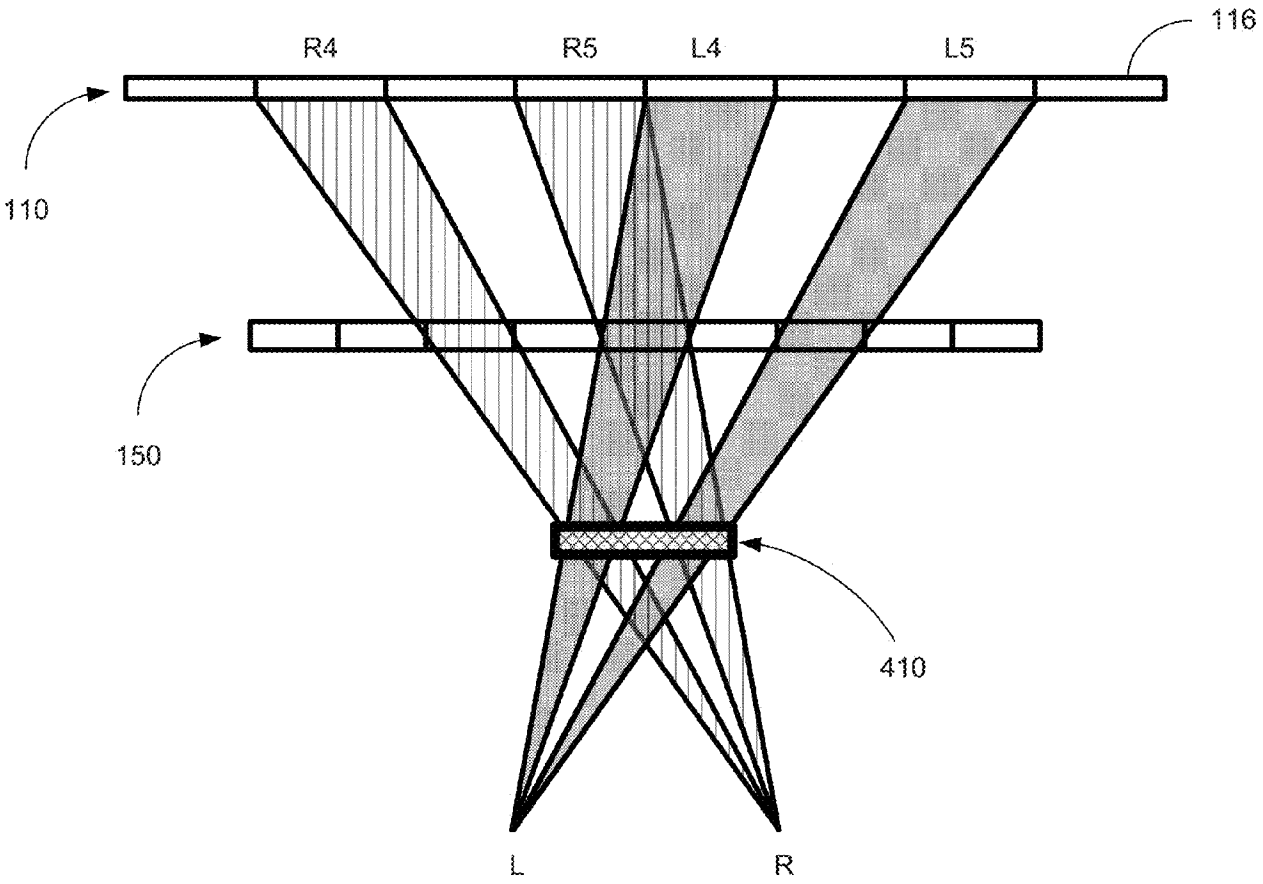
FIG. 4B schematically depicts depth perception of a virtual object with three-pixel offset according to one embodiment of the present disclosure.

FIGS. 4A and 4B use the three-dimensional display device having a parallax barrier module to depict two examples of depth perception of a virtual object with different pixel offset. As shown in FIG. 4A, for a viewer in the optimum viewable zone (eye positions shown as the letters L and R), the pixels 116 labeled (L1, L2, L3) provide the left-eye view, and the pixels labeled (R1, R2, R3) provide the right-eye view, forming a virtual object 400 having a width of three pixels 116. The pixel offset of the two offset images is the minimum one-pixel offset, with each pixel (L1, L2, L3) being one pixel away from the corresponding pixel (R1, R2, R3). In this case, the virtual object 400 is positioned right on the barrier module 150.

On the other hand, as shown in FIG. 4B, for a viewer in the optimum viewable zone (eye positions shown as the letters L and R), the pixels 116 labeled (L4, L5) provide the left-eye view, and the pixels 116 labeled (R4, R5) provide the right-eye view, forming a virtual object 410 having a width of two pixels 116. The pixel offset of the two offset images is a three-pixel offset, with each pixel (L4, L5) being three pixels away from the corresponding pixel (R4, R5). In this case, the viewer perceives the virtual object 410 to be "floated" out-of-screen from the barrier module 150, moving closer to the viewer. As shown in FIG. 4B, the position of the virtual object 410 may be calculated by the projections of the two offset images. In other words, the position of the virtual object 410 can be determined according to the pixel offset.

The hover sensing module 170 is a sensing device for sensing a hovering action of an object within a certain distance in front of the hover sensing module 170. In certain embodiments, the hover sensing module 170 may be a transparent sensing film attached on the barrier module 150 at the DJ side. In certain embodiments, the hover sensing module 170 and the barrier module 150 may be an integrated layer attached on the transparent display module 110. In certain embodiments, the hover sensing module 170 may include multiple film layers, and each film layer of the hover sensing module 170 may be respectively disposed in front of, behind, or in-between the transparent display module 110 and the barrier module 150.

The term "hovering", as used herein, refers to a non-touching triggering action with touch sensing devices, such as touch panels or touch screens. Generally, a touch sensing device provides a touch surface for a user (the viewer) to use a finger or fingers to touch and move around the touch surface to input certain commands, e.g., moving a cursor, clicking a button, or pressing a key shown on the display device. However, some touch sensing devices may detect non-touching actions within a certain range in front of the touch surface, allowing the user to use hand movement or movement of an object (such as using a pen or a pointer object) in front of the touch surface without actually touching the touch surface to trigger the input commands. Such non-touching triggering actions are called hovering. In other words, hovering is essentially a "touchless touching" action because the moving hand or the moving object (e.g., pen) does not directly contact the touch panel.

In certain embodiments, a touch sensing device with hovering sensing functions may be switchable between a touch-only mode and a hovering mode. For example, a capacitance touch sensing device may provide the hovering sensing functions. In the touch-only mode, the touch sensing device is only responsive to touching actions, and does not detect hovering actions. In the hovering mode, the touch sensing device may detect both touching and hovering actions. To implement such a switchable touch sensing device, the touch sensing device may include a touch sensing module for detecting touching actions and a separate hover sensing module for detecting hovering actions. In certain embodiments, a switchable sensing module may be used for detecting both touching and hovering actions. For the three-dimensional audio visual display device 100, either the separate hover sensing module or the switchable sensing module may be adopted as the hover sensing module 170.

Figure 5A:
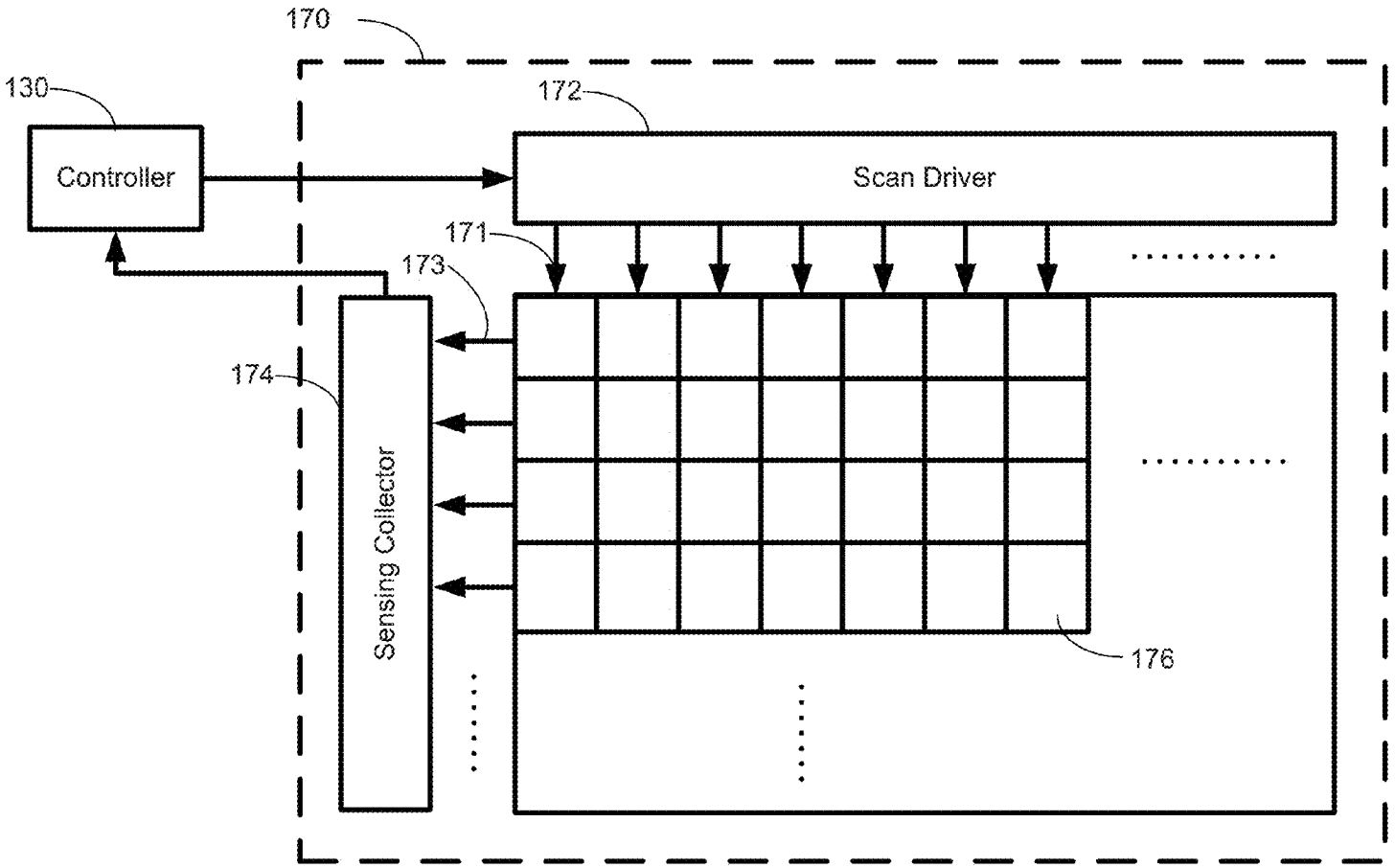
FIG. 5A schematically depicts a hover sensing module according to one embodiment of the present disclosure.

FIG. 5A schematically depicts a hover sensing module according to one embodiment of the present disclosure. As shown in FIG. 5A, the hover sensing module 170 includes a scan driver 172 and a sensing collector 174 respectively connected to the controller 130. The scan driver 172 is configured to receive scan signals from the controller 130. The sensing collector 174 is configured to collect sensing signals corresponding to the objects in front of the hover sensing module 170, and to send the sensing signals to the controller 130 for processing. Further, a plurality of capacitive sensing units 176 is defined on the hover sensing module 170 to form a capacitive matrix. Each capacitive sensing unit 176 has a two-dimensional location (X, Y) on the capacitive matrix. The scan driver 172 is electrically connected to a plurality of scan lines 171 to transmit the scan signals to each of the capacitive sensing units 176 along the column direction of the capacitive matrix, and the sensing collector 174 is electrically connected to a plurality of sensing lines 173 to receive the sensing signals from the capacitive sensing units 176 along the row direction of the capacitive matrix. In other words, each capacitive sensing unit 176 is electrically connected to at least one scan line 171 and at least one sensing line 173. In certain embodiments, the capacitive matrix may be formed by capacitive electrodes or ultrasonic transducers.

Figure 5B:
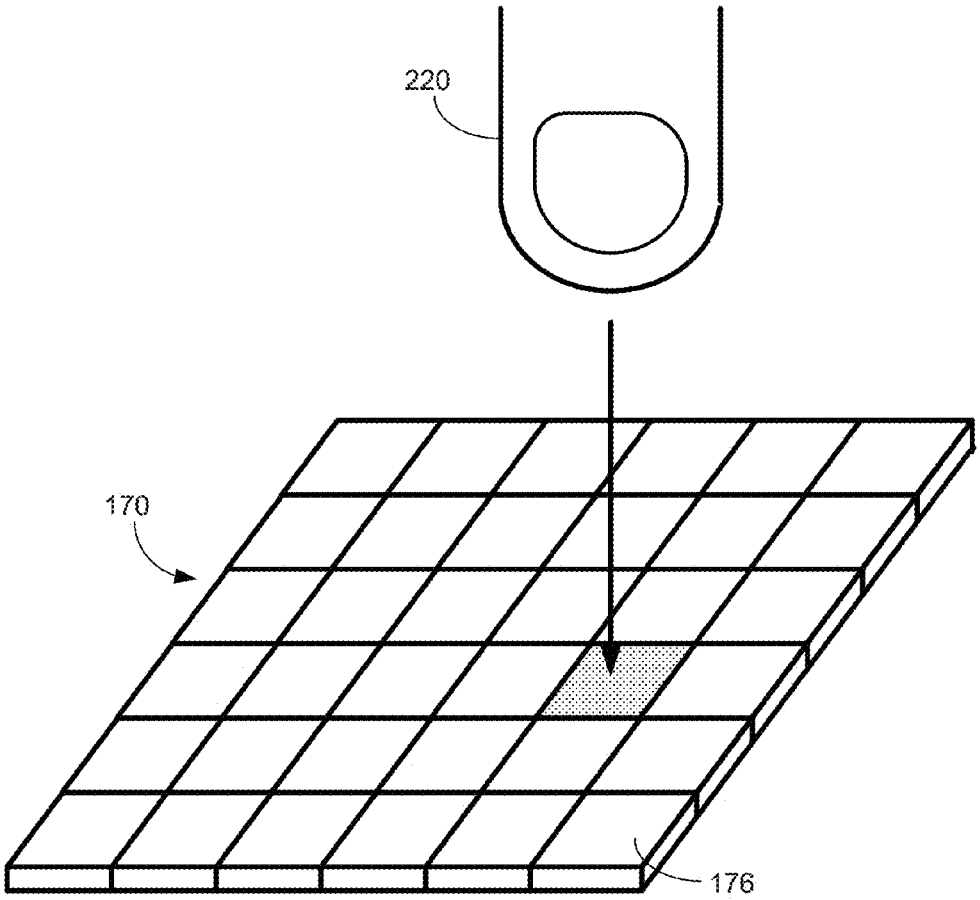
FIG. 5B schematically depicts a capacitive matrix of the hover sensing module according to one embodiment of the present disclosure.

FIG. 5B schematically depicts a capacitive matrix of the hover sensing module according to one embodiment of the present disclosure. As shown in FIG. 5B, the size of each capacitive sensing unit 176 is relatively small such that each virtual equipment corresponds to multiple capacitive sensing units 176. In certain embodiments, when an object (e.g. the finger 220) approaches the capacitive matrix of the hover sensing module 170, the finger 220 may trigger all nearby capacitive sensing units 176 to generate a sensing signal. However, the capacitive sensing unit 176 along the pointing direction of the finger 220, as shown by the dotted area, may generate the largest sensing signal because of the relatively shortest distance between the capacitive sensing unit 176 and the finger 220. Accordingly, by detecting and comparing all sensing signals generated by the capacitive sensing units 176 of the hover sensing module 170, a three-dimensional object coordinate (X, Y, Z) can be determined, where (X, Y) refers to the two-dimensional location of the capacitive sensing unit 176 on the capacitive matrix, and Z refers to the distance between the capacitive sensing unit 176 and the finger 220.

Figure 5C:
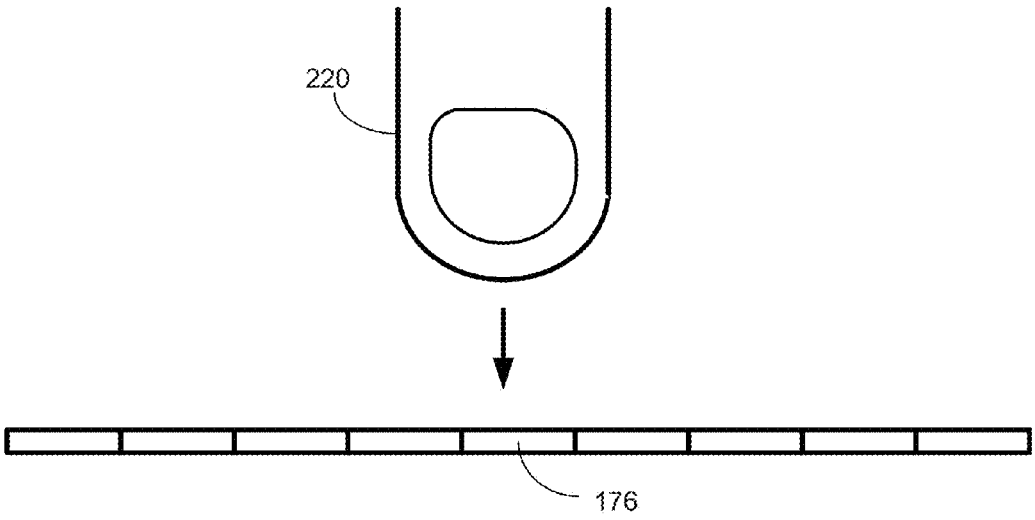
FIG. 5C schematically depicts a finger triggering a hover sensing module formed by capacitive sensor electrodes according to one embodiment of the present disclosure.

In certain embodiments, the capacitive sensing units 176 of the hover sensing module 170 may be capacitive sensor electrodes. FIG. 5C schematically depicts a finger triggering a hover sensing module formed by capacitive sensor electrodes according to one embodiment of the present disclosure. The capacitive sensor electrodes can be made of electrode materials, as long as the material may induce a capacitance change when a finger or an object approaches. Thus, the induced capacitance change may be the sensing signal. In certain embodiments, the capacitive sensor electrodes can be made of transparent electrode materials. In certain embodiments, the capacitive sensor electrodes can be made of conductive metals such as copper or indium tin oxide (ITO).

As shown in FIG. 5C, when an object (e.g. the finger 220) approaches the capacitive matrix of the hover sensing module 170, the finger 220 may trigger all nearby capacitive sensor electrodes 176 such that each capacitive sensor electrode 176 induces a capacitance change due to the existence of the finger 220. The induced capacitance change is determined by the distance Z between the capacitive sensor electrode 176 and the finger 220, where a shorter distance Z induces a larger capacitance change. Thus, the capacitive sensor electrode 176 along the pointing direction of the finger 220 may generate the largest induced capacitance change. Accordingly, by detecting and comparing all capacitance changes of the capacitive sensor electrodes 176 of the hover sensing module 170, and comparing the largest induced capacitance change to a plurality of predetermined standardized capacitance change values, the object coordinate (X, Y, Z) can be determined.

Figure 5D:
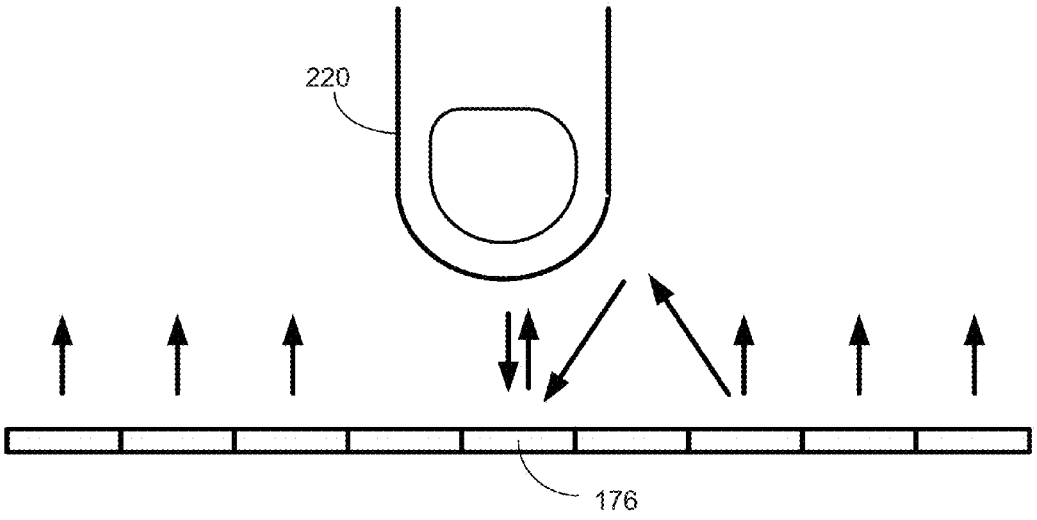
FIG. 5D schematically depicts a finger triggering a hover sensing module formed by capacitive micromachined ultrasonic transducers (CMUTs) according to one embodiment of the present disclosure.

In certain embodiments, the hover sensing module 170 may be a high-intensity focused ultrasound (HIFU) transducer panel formed by CMUTs. FIG. 5D schematically depicts a hover sensing module formed by CMUTs according to one embodiment of the present disclosure. As shown in FIG. 5D, each capacitive sensing unit 176 is a CMUT array, including a plurality of CMUT units. In certain embodiments, a CMUT unit is constructed on silicon using micromachining technique, and the size of the CMUT units can be relatively small such that each virtual equipment may correspond to one or more CMUT arrays. To form a CMUT unit, a cavity is formed in a silicon substrate. A thin layer is suspended on the top of the cavity to serve as a membrane on which a metallized layer acts a top electrode, together with the silicon substrate which serves as a bottom electrode. The CMUT unit may work as a transmitter/receiver of ultrasonic waves. When an AC signal is applied across the biased electrodes, the CMUT unit generates ultrasonic waves in the medium of interest. In this case, the CMUT unit works as a transmitter. On the other hand, when ultrasonic waves are applied on the membrane of the biased CMUT unit, the capacitance of the CMUT unit is changed to generate an alternating signal. In this case, the CMUT unit works as a receiver of ultrasonic waves.

When the HIFU transducer panel is used as the hover sensing module 170, the controller 130 periodically sends AC pulse signals to the CMUT units for generating and transmitting ultrasonic waves. As long as the CMUT units receive the AC pulse signals, the CMUT units transmit ultrasonic waves. As shown in FIG. 5D, when an object (e.g. the finger 220) approaches the capacitive matrix of the hover sensing module 170, the finger 220 may reflect the ultrasonic waves transmitted by all nearby CMUT arrays 176 such that each CMUT array 176 may receive the reflected ultrasonic waves to generate alternating signals. Since the ultrasonic waves has a predetermined transmission speed, the distance Z between the CMUT array 176 and the finger 220 is one half of the transmission distance of the ultrasonic waves, which may be calculated by multiplying the transmission time of the ultrasonic waves to the speed. Accordingly, by calculating and average all transmission distance of the ultrasonic waves of the CMUT units in each CMUT array, the object coordinate (X, Y, Z) can be determined.

It should be appreciated that the CMUT units may transmit the ultrasonic waves to any direction, and may receive reflected ultrasonic waves transmitted by other CMUT units. However, as shown in FIG. 4D, the transmission distance of the ultrasonic wave in a perpendicular direction to the hover sensing module 170 may be the shortest transmission distance. Thus, the first reflected ultrasonic wave receive by a CMUT unit is always the ultrasonic wave transmitted by the CMUT unit. In other words, for a CMUT unit, the transmission time of the ultrasonic waves is the time period from the transmission of the ultrasonic waves to the time when the CMUT unit firstly receives a reflected ultrasonic wave.

It should be appreciated that different types of capacitive sensing units 176 may have different advantages in sensitivity and sensible ranges. For example, the CMUT arrays may detect objects from a longer distance than the capacitive sensor electrodes. On the other hand, the capacitive sensor electrodes may be more power efficient.

Figure 5E:
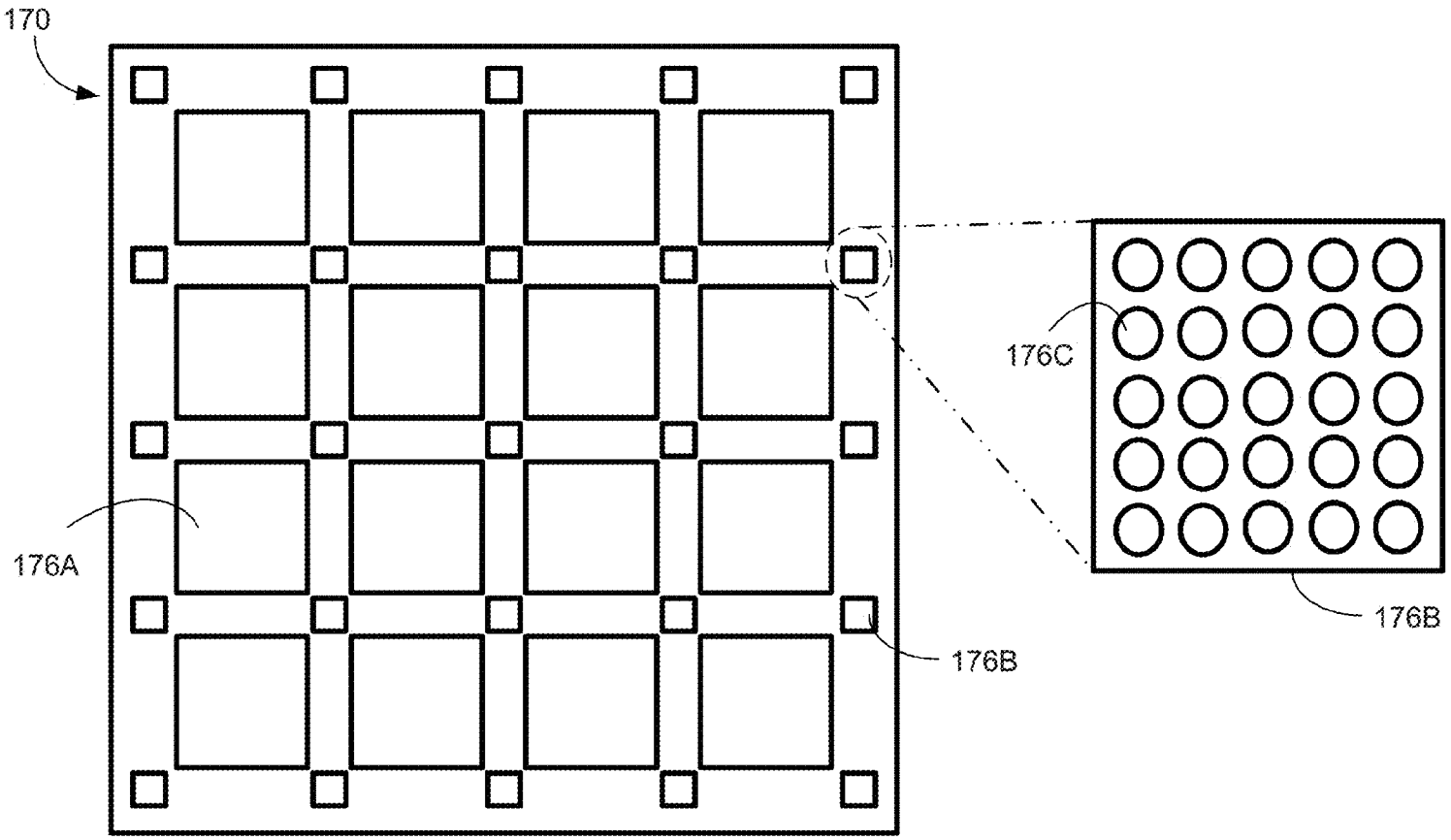
FIG. 5E schematically depicts a hover sensing module formed by both capacitive sensor electrodes and CMUTs according to one embodiment of the present disclosure.
Figure 5F:
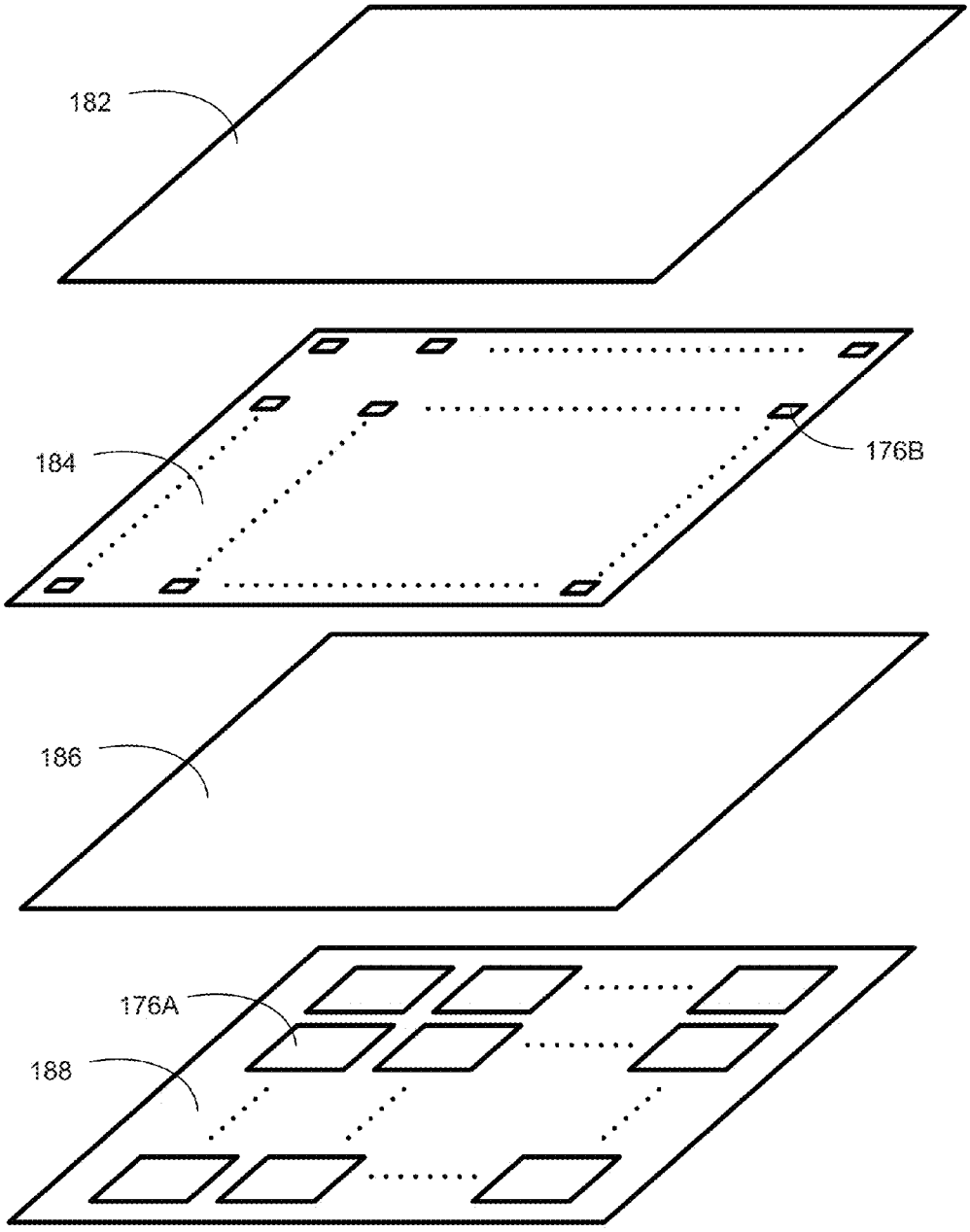
FIG. 5F schematically depicts the dissembled layer view of the hover sensing module as shown in FIG. 5E according to one embodiment of the present disclosure.

In certain embodiments, the hover sensing module 170 may use two or more types of capacitive sensing units 176 to form a multi-hover sensing device. FIGS. 5E and 5F schematically depict a hover sensing module formed by both capacitive sensor electrodes and CMUTs according to one embodiment of the present disclosure, where FIG. 5E shows a top view, and FIG. 5F shows a dissembled perspective view.

As shown in FIG. 5E, the hover sensing module 170 includes both capacitive sensor electrodes 176A and CMUT arrays 176B as the capacitive sensing units. In certain embodiments, each capacitive sensor electrode 176A is a 3*3 $mm^2$ square, and each two adjacent capacitive sensor electrodes 176A has a 1 mm gap therebetween. In certain embodiments, each CMUT array 176B is located at the corner of the capacitive sensor electrodes 176A. Each CMUT array 176B is a 750*750 $um^2$ square, and is formed with 5*5 CMUT units 176C. Each CMUT unit 176C has a circular shape with a diameter of 100 um, and the distance between two adjacent CMUT units 176C is 150 um.

As shown in FIG. 5F, the hover sensing module 170 has four layers, including a cover layer 182, a HIFU layer 184, an isolation layer 186 and an electrode layer 188. The cover layer 182 is a protective layer, covering other layers of the hover sensing module 170. The HIFU layer 184 is the layer where the CMUT arrays 176B are formed. The isolation layer 186 is a layer isolating the HIFU layer 184 and the electrode layer 188 to prevent from short-circuiting. The electrode layer 188 is a printed circuit board (PCB) layer where the capacitive sensor electrodes 176A are formed. In certain embodiments, the thickness of the cover layer 182 is 150 um, the thickness of the HIFU layer 184 is 8 um, the thickness of the isolation layer 186 is 1 mm, and the thickness of the electrode layer 188 is 1.6 mm.

It should be appreciated that the exemplary embodiments of the hover sensing module 170 are presented only for the purposes of illustration and description, and are not intended to limit the structure of the hover sensing module 170.

The controller 130 controls operations of the transparent display module 110, the barrier module 150, and the hover sensing module 170. Specifically, the controller 130 is configured to generate display signals for controlling the pixels 116 of the display panels 110 to display the images, and to control the hover sensing module 170 to measure sensing signals of the object. In certain embodiments, when the barrier module 150 is switchable between the two-dimensional and three-dimensional display modes, the controller 130 is configured to generate control signals for switching the barrier module 150 between the two modes.

Figure 6A:
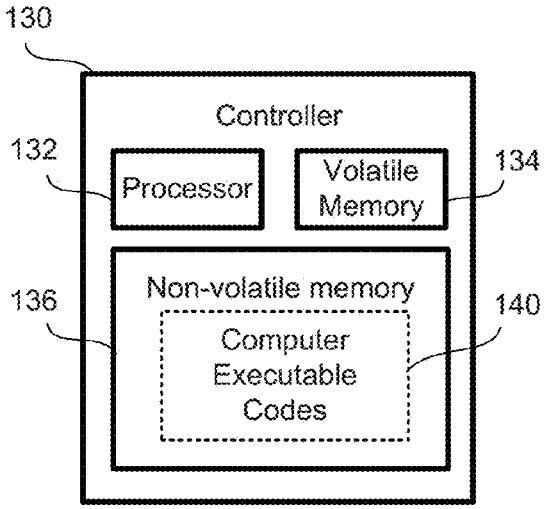
FIG. 6A schematically depicts a controller of the display device according to one embodiment of the present disclosure.

FIG. 6A schematically depicts a controller of the display device according to one embodiment of the present disclosure. As shown in FIG. 6A, the controller 130 includes one or more processors 132 for executing instructions, one or more volatile memory 134, and one or more non-volatile memory 136. In certain embodiments, the controller 130 may be one or more specialized microcontroller capable of being installed in a computer, such as a microcontroller unit (MCU), a service processor (SP) or a baseboard management controller (BMC). Each specialized microcontroller may include one or more chipsets, and may include a processor 132, a volatile memory 134, and a non-volatile memory 136. In certain embodiments, the controller 130 may include other storage devices in addition to the volatile memory 134 and the non-volatile memory 136. For example, the storage devices may include a static random-access memory (RAM), a flash memory, or any types of storage unit as long as it may store data.

The processor 132 is a host processor of the controller 130, controlling operation and executing instructions of the controller 130. The volatile memory 134 is a temporary memory storing information in operation, such as the instructions executed by the processor 132. In certain embodiments, the volatile memory 134 may be a random-access memory (RAM). In certain embodiments, the volatile memory 134 is in communication to the processor 132 through appropriate buses or interfaces. In certain embodiments, the controller 130 may include more than one processor 132 or more than one volatile memory 134.

The non-volatile memory 136 is a persistent memory for storing data and instructions even when not powered. For example, the non-volatile memory 136 can be a flash memory. In certain embodiments, the non-volatile memory 136 is in communication to the processor 132 through appropriate buses or interfaces. In certain embodiments, the controller 130 may include more than one non-volatile memory 136.

As shown in FIG. 6A, the non-volatile memory 136 stores computer executable codes 140. The codes 140 are configured, when executed at the processor 132, to control the pixels 116 of the transparent display module 110, to control the sensing of the hover sensing module 170, and to control the barrier module 150.

Figure 6B:
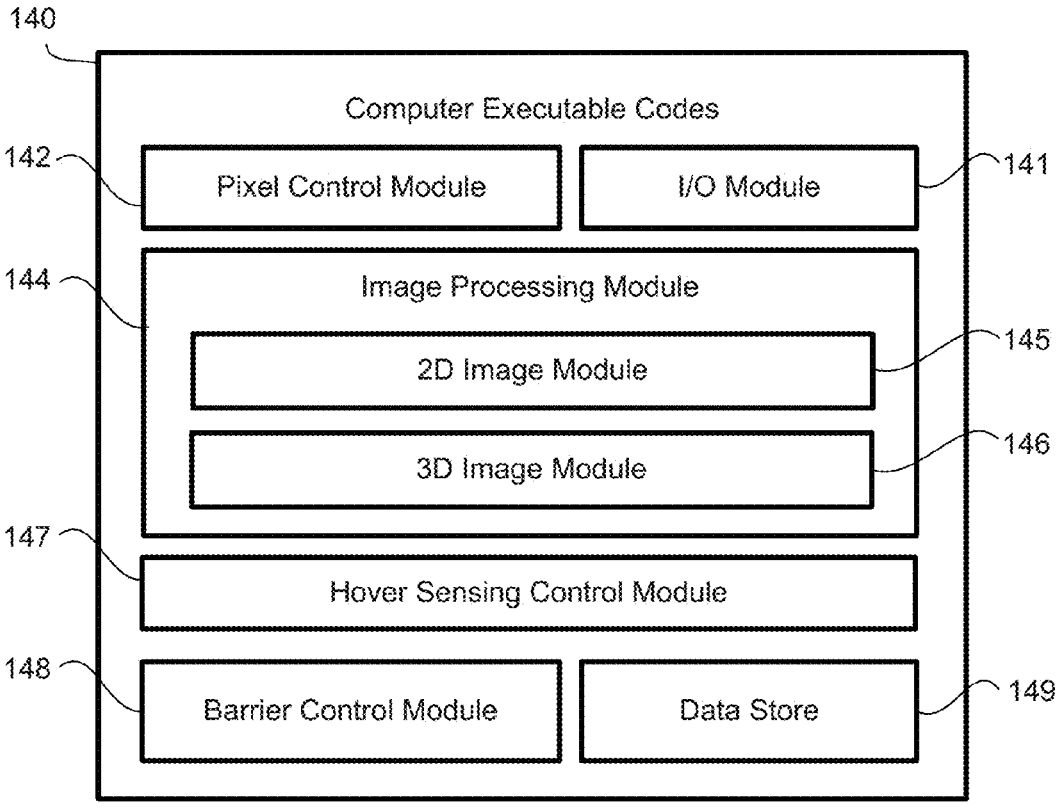
FIG. 6B schematically depicts computer executable codes of the controller according to one embodiment of the present disclosure.

FIG. 6B schematically depicts computer executable codes of the controller according to one embodiment of the present disclosure. As shown in FIG. 6B, the codes 140 include an input/output (I/O) module 141, a pixel control module 142, an image processing module 144, a hover sensing control module 147, a barrier control module 148, and one or more data stores for storing parameters and operational data for the modules. In certain embodiments, the image processing module 144 includes a 2D image module 145 for processing two-dimensional images, and a 3D image module 146 for processing three-dimensional images.

The I/O module 141 controls the correspondence of the input signals and the output signals. For example, when the DJ 500 inputs a command via a peripheral input device connected to the controller 130, such as a keyboard, a mouse, a touch panel or other input devices, the I/O module 141 receives the input signals corresponding to the commands, and processes with the commands. When the controller 130 generates output signals for a corresponding output device, such as the display signals (the scan signals and the data signals) for the pixels 116 of the transparent display module 110, the I/O module 141 sends the output signals to the corresponding output device.

The pixel control module 142 generates the display signals (the scan signals and data signals) for controlling the pixels 116 of the transparent display module 110. When the pixel control module 142 receives an image signal from the image processing module 144 for display of certain images on the transparent display module 110, the pixel control module 142 generates the corresponding scan signals and data signals according to the image signals, and sends the scan signals and data signals to the scan driver 114 and data driver 112 of the transparent display module 110 via the I/O module 141. The image signals can include two-dimensional or three-dimensional images, or a combination of both two-dimensional and three-dimensional images.

The image processing module 144 is configured to process the two-dimensional and three-dimensional images to generate corresponding image signals for the pixel control module 142. In certain embodiments, the image processing module 144 includes a 2D image module 145 for processing two-dimensional images, and a 3D image module 146 for processing three-dimensional images. For example, when the virtual equipment is displayed in the three-dimensional display mode, the 3D image module 146 processing the three-dimensional image for the virtual equipment. When the virtual equipment is displayed in the two-dimensional display mode, the 2D image module 145 processing the two-dimensional image for the virtual equipment.

The 2D image module 145 processes images in the two-dimensional display mode and generates corresponding image signals for the two-dimensional images. Generally, to display an image in its original size in the two-dimensional display mode, the image is processed in a pixel-to-pixel method. In other words, only one pixel 116 of the transparent display module 110 is used for displaying the image data corresponding to the one pixel 116. Thus, for each pixel of the image, the 2D image module 145 processes data to generate an image signal corresponding to the pixel, and send the image signal to the pixel control module 142.

The 3D image module 146 processes images in the three-dimensional display mode and generates corresponding image signals for the three-dimensional images. As described above, in the three-dimensional display mode, all pixels 116 in the pixel matrix are divided into two sets. For example, the pixels 116 corresponding to the left-eye view are the pixels 116 with odd numbers in the region 116L, and the pixels 116 corresponding to the right-eye view are the pixels 116 with even numbers in the region 116R. In other words, two pixels 116 (one odd-number pixel and one even-number pixel) are used for displaying the image data corresponding to the one pixel 116, regardless of the image being two-dimensional or three-dimensional.

The hover sensing control module 147 controls the operation of the hover sensing module 170. When the hover sensing control module 147 receives a hover sensing instruction to start detecting hovering actions, the hover sensing control module 147 generates the corresponding scan signals, and sends the scan signals to the scan driver 172 of the hover sensing module 170. When the hover sensing control module 147 receives the sensing signals from the hover sensing module 170, the hover sensing control module 147 processes the sensing signals to determine the object coordinate (X, Y, Z).

In certain embodiments, certain hand gestures or hand movements may be used to trigger predetermined actions. For example, a finger moving along a vertical direction may relate to adjusting a switch of the sound recording equipment or scratching a turntable. To recognize such predetermined hand gestures or hand movements, once an object is detected at the object coordinate (X, Y, Z), the hover sensing control module 147 may be used to track a detected object by monitoring the nearby area of the object coordinate (X, Y, Z). For example, when the hover sensing control module 147 processes the sensing signals from the hover sensing module 170 and determines an object to exist at the object coordinate (X, Y, Z), the hover sensing control module 147 monitors the nearby area to the object coordinate (X, Y, Z) in the next time frame. If another object is detected at a nearby area to the object coordinate (X, Y, Z) in the next time frame, the hover sensing control module 147 may determine the second object as the same object to the first object at the object coordinate (X, Y, Z). By tracking the object movements in consecutive time frames, hand gestures or hand movements may be detected.

The barrier control module 148 controls the operation of the barrier module 150. In certain embodiments, when the barrier module 150 is a parallax barrier module 150 switchable between two-dimensional and three-dimensional modes, the barrier control module 148 may control the opaque units 154 to be switchable between the transparent state and the opaque state. When the barrier control module 148 receives a display instruction to switch to the two-dimensional mode, the barrier control module 148 controls the opaque units 154 to become transparent. When the barrier control module 148 receives a display instruction to switch to the three-dimensional mode, the barrier control module 148 controls the opaque units 154 to become opaque.

The data store 149 is configured to store parameters of the audio visual display device 100, including, among other things the resolution of the transparent display module 110, the display parameters for displaying in the two-dimensional and three-dimensional modes, and the sensing parameters for the hover sensing module 170. In certain embodiments, the data store 149 stores a plurality of parameters for virtual DJ equipment, with each virtual equipment having different layouts and predetermined virtual positions. For example, for a certain type of virtual turntable to be displayed at a predetermined position, the display parameters for the virtual turntable may include the position of the turntable and predetermined transparency of the virtual turntable. The sensing parameters for the virtual turntable may include the type of capacitive sensing units 176 of the hover sensing module 170, standardized capacitance change values for determining the distance Z from the capacitive sensing unit 176 to the finger 220, a coordinate list for each key defining the ranges of the coordinate (X, Y, Z) corresponding to the turntable, and predetermined hand movements or gestures to trigger any turntable actions.

Figure 7:
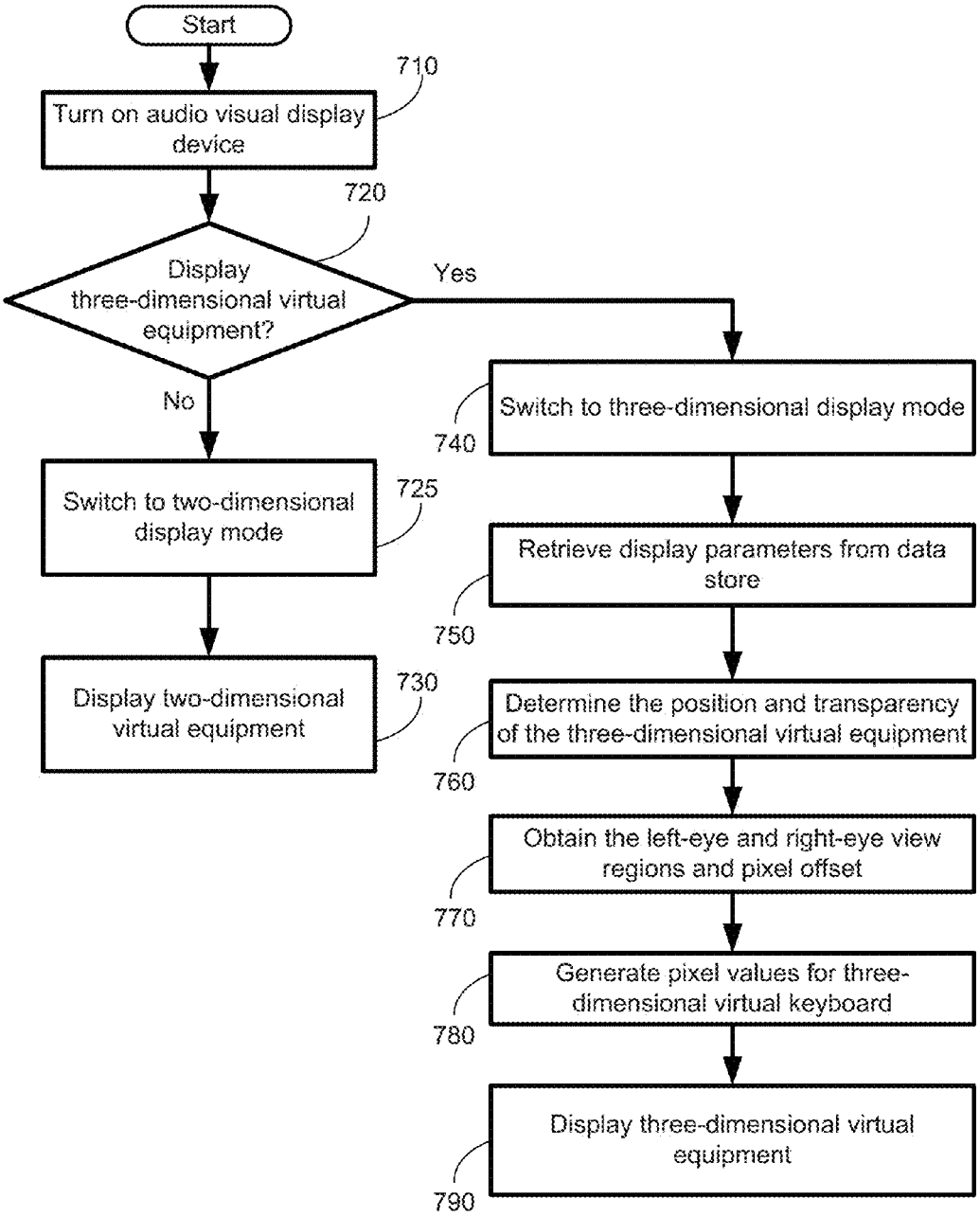
FIG. 7 shows an exemplary flow chart of displaying the virtual equipment according to one embodiment of the present disclosure.

FIG. 7 shows an exemplary flow chart of displaying the virtual equipment according to one embodiment of the present disclosure.

At operation 710, the audio visual display device 100 is turned on, and the controller 130 launches the codes 140. In certain embodiments, when the audio visual display device 100 is turned on, the predetermined display mode is the two-dimensional display mode, and a viewer may input commands to switch the display mode to the three-dimensional display mode.

At operation 720, the viewer (e.g. the DJ 500) may determine if there is a need for displaying the three-dimensional virtual equipment. For example, the DJ 500 may choose from one of the out-of-screen three-dimensional virtual equipment or the on-screen two-dimensional virtual equipment. When the viewer confirms displaying of the three-dimensional virtual equipment, the controller 130 enters operation 740 to switch the display mode to the three-dimensional display mode. When the viewer does not intend to use the three-dimensional virtual equipment, the controller 130 enters operation 725 to switch to the two-dimensional display mode. At operation 730, the audio visual display device 100 displays the two-dimensional virtual equipment on the screen.

After the controller 130 switches the display mode to the three-dimensional display mode, at operation 750, the 3D image module 146 of the image processing module 144 retrieves display parameters of the three-dimensional virtual equipment from the data store 149. As described above, the data store 149 may store display parameters for different types of virtual equipment at different positions. In certain embodiments, the controller 130 may display a list of information of the virtual equipment on the display module for the DJ 500 to choose from.

At operation 760, the 3D image module 146 determines the position and transparency of the three-dimensional virtual equipment. Specifically, the 3D image module 146 receives a command from the viewer to select one of the virtual equipment with the predetermined position and transparency. At operation 770, the 3D image module 146 obtains the left-eye and right-eye view regions and pixel offset corresponding to the virtual equipment at the position. At operation 780, the 3D image module 146 generates the pixel values for the three-dimensional virtual equipment, which is shown by the pixels 116 in the two regions 116L and 116R.

At operation 790, the controller 130 displays the three-dimensional virtual equipment on the transparent display module 110. Specifically, the 3D image module 146 sends the pixel values for all pixels as image signals to the pixel control module 142. The pixel control module 142 generates the display signals (the scan signals and the data signals) according to the image signals, and sends the display signals to the transparent display module 110 via the I/O module 141. Upon receiving the display signals, the transparent display module 110 displays the images. When the DJ 500 sees the image displayed by the transparent display module 110, the DJ 500 perceives the three-dimensional virtual equipment at the predetermined position.

Figure 8:
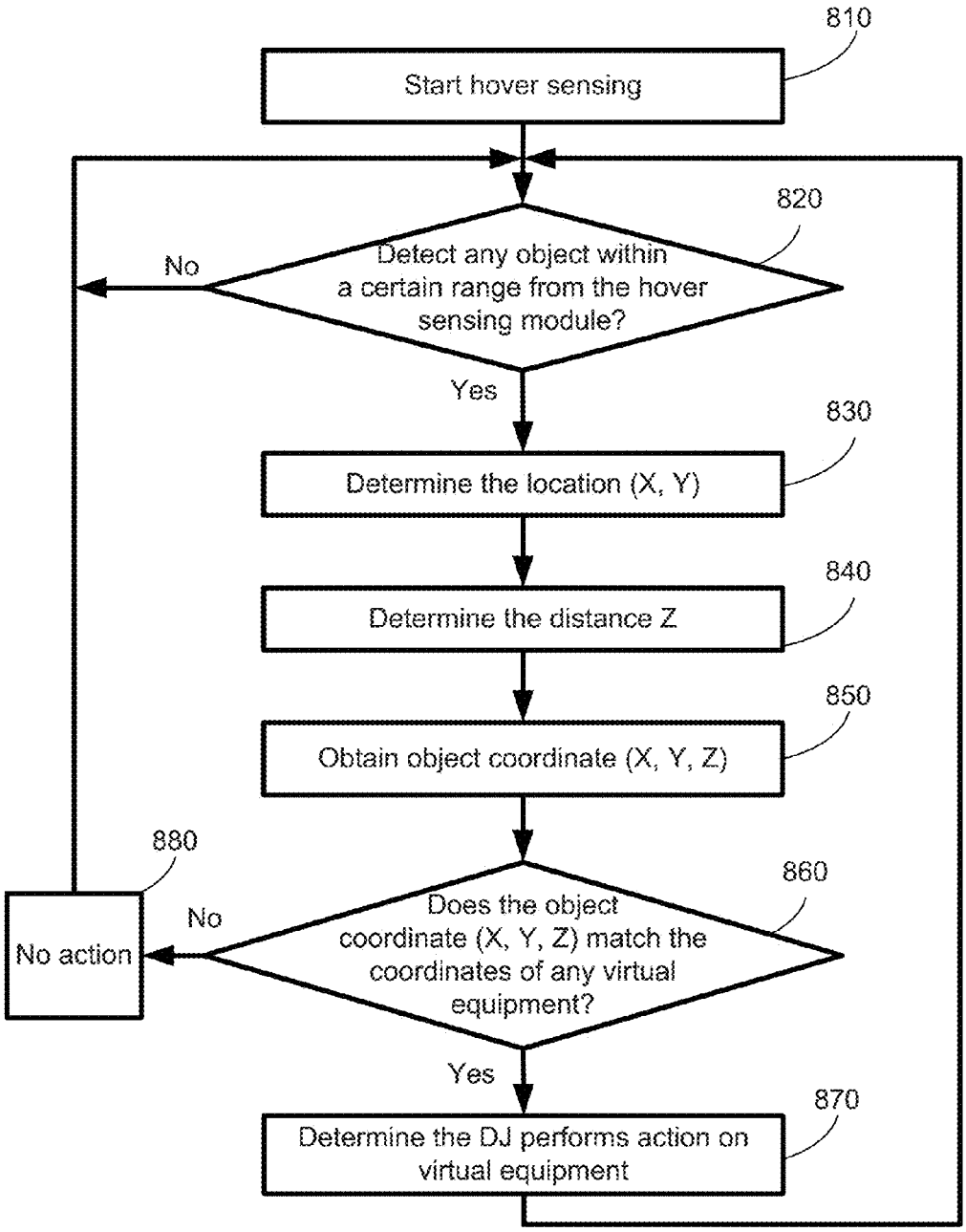
FIG. 8 shows an exemplary flow chart of detecting hovering action for the virtual equipment according to one embodiment of the present disclosure.

FIG. 8 shows an exemplary flow chart of detecting hovering action for the virtual equipment according to one embodiment of the present disclosure.

At operation 810, once the two-dimensional or three-dimensional virtual equipment is displayed, the hover sensing control module 147 controls the hover sensing module 170 to start hover sensing. Specifically, the hover sensing control module 147 generates the scan signals, sends the scan signals to the scan driver 172 of the hover sensing module 170, and receives the sensing signals from the hover sensing module 170.

At operation 820, the hover sensing control module 147 determines whether any object exists within a certain range from the hover sensing module 170. In certain embodiments, the hover sensing control module 147 compares the sensing signals to one or more standardized sensing signals. For example, when the hover sensing module 170 is formed by the capacitive sensor electrodes, the hover sensing control module 147 compares the capacitance change of each capacitive sensor electrode with predetermined standardized capacitance change values. If any value of the capacitance change is larger than or equal to the predetermined standardized capacitance change values, the hover sensing control module 147 determines that an object exists within a certain range from the hover sensing module 170, and enters operation 830. If all values are smaller than the predetermined standardized capacitance change values, the hover sensing control module 147 determines that no object exists within the certain range, and returns to 820 for the next detecting cycle.

At operation 830, the hover sensing control module 147 determines the location (X, Y) of the object. As described above, the capacitive sensing unit 176 along the pointing direction of the object (e.g. the finger 220) may generate the largest sensing signal because of the relatively shortest distance between the capacitive sensing unit 176 and the finger 220. Thus, the hover sensing control module 147 compares all sensing signals, and determines the location coordinate (X, Y) of the capacitive sensing unit 176 having the largest sensing signal to be the location of the object.

At operation 840, the hover sensing control module 147 determines the distance Z of the object. For different capacitive sensing units 176, the distance Z may be obtained in a different way. For example, for CMUT arrays, the distance Z is one half of the transmission distance of the ultrasonic waves, which may be calculated by multiplying the transmission time of the ultrasonic waves to the speed. For capacitive sensor electrodes, the distance Z may be determined by comparing the largest induced capacitance change to a plurality of predetermined standardized capacitance change values.

Once the location (X, Y) and the distance Z of the object are obtained, at operation 850, the hover sensing control module 147 obtains the object coordinate (X, Y, Z).

At operation 860, the hover sensing control module 147 compares the object coordinate (X, Y, Z) to the coordinates of the virtual equipment to determine whether the object coordinate (X, Y, Z) matches the virtual equipment. As described above, the size of each capacitive sensing unit 176 is relatively small such that the virtual equipment corresponds to multiple capacitive sensing units 176. In certain embodiments, each virtual equipment may have a coordinate list stored in the data store 149 to define the ranges of the coordinate (X, Y, Z) corresponding to the virtual equipment. The hover sensing control module 147 may retrieve the coordinate list for each virtual equipment and compares the object coordinate (X, Y, Z) to the coordinate list. When there is no match for the object coordinate (X, Y, Z), the hover sensing control module 147 determines that the DJ 500 performs no action, and returns to operation 820 for the next detecting cycle. When the object coordinate (X, Y, Z) matches the coordinates of a certain key, the hover sensing control module 147 enters operation 870 to determine the DJ 500 performs certain action to the virtual equipment. In certain embodiments, the hover sensing control module 147 sends a command corresponding to the DJ action to the I/O module 141, and then returns to operation 820 for the next detecting cycle.

The foregoing description of the example of the digital media management software has been presented only for the purposes of illustration and description and is not intended to be exhaustive or to limit the disclosure to the precise forms disclosed. Many modifications and variations are possible in light of the above teaching.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An audio visual display device, comprising:

a transparent display module defining a plurality of pixels in a pixel matrix;

a sensing module configured to receive a plurality of first scan signals, detect an object at a disc jockey (DJ) side of the transparent display module in response to receiving the first scan signals, and to generate a plurality of sensing signals in response to detecting the object; and a controller electrically connected to the transparent display module and the sensing module, the controller comprising a processor and a non-volatile memory storing computer executable codes, wherein the codes, when executed at the processor, are configured to generate the first scan signals for the sensing module, and send the first scan signals to the sensing module;

generate display signals, and send the display signals to the transparent display module to control the pixels to display an image corresponding to the display signals;

receive the sensing signals from the sensing module, and generate an object coordinate according to the sensing signals;

in response to an audio visual display instruction, generate the display signals corresponding to a virtual disc jockey equipment; and in response to the object coordinate matching coordinates of the virtual disc jockey equipment, generate an audio effect command for the virtual disc jockey equipment.

2. The audio visual display device as claimed in claim 1, further comprising:

a barrier module disposed at the DJ side of the transparent display module, wherein for a DJ at the DJ side, the barrier module is configured to allow light emitted from a first set of the pixels to be viewable only by a left eye of the DJ, and allow light emitted from a second set of the pixels to be viewable only by a right eye of the DJ, such that the DJ perceives the light emitted from the first set of the pixels as a left-eye view and the light emitted from the second set of the pixels as a right-eye view, and perceives the left-eye view and the right view to form a three-dimensional virtual image between the DJ and the transparent display module.

3. The audio visual display device as claimed in claim 2, wherein the barrier module is a parallax barrier layer, comprising a plurality of transparent units and a plurality of opaque units alternatively positioned.

4. The audio visual display device as claimed in claim 2, being switchable between a two-dimensional display mode and a three-dimensional display mode.

5. The audio visual display device as claimed in claim 1, wherein the codes comprise:

a pixel control module configured to generate the display signals in response to a plurality of image signals, and send the display signals respectively to the display module to control the pixels;

an image processing module configured to generate the image signals from the image; and a sensing control module configured to generate the first scan signals for the sensing module, receive the sensing signals from the sensing module, and generate the object coordinate by comparing the sensing signals.

6. The audio visual display device as claimed in claim 5, wherein the sensing module comprises a plurality of capacitive sensing units in a capacitive matrix, wherein each of the capacitive sensing units is configured to receive one of the first scan signals generated by the sensing control module, to generate the sensing signals in response to the first scan signal, and to send the sensing signals to the sensing control module.

7. The audio visual display device as claimed in claim 6, wherein the capacitive sensing units are capacitive sensor electrodes, and wherein each of the capacitive sensor electrodes is configured to induce a capacitance change when the object exists within a predetermined range of the capacitive sensor electrode.

8. The audio visual display device as claimed in claim 6, wherein the capacitive sensing units are capacitive micromachined ultrasonic transducer (CMUT) arrays, and each of the CMUT arrays comprises a plurality of CMUT units, wherein each of the CMUT arrays is configured to transmit ultrasonic waves and to receive refracted ultrasonic waves by the objects.

9. The audio visual display device as claimed in claim 1, wherein the display signals comprise a plurality of second scan signals and a plurality of data signals.

10. The audio visual display device as claimed in claim 9, wherein the transparent display module comprises:

a scan driver electrically connected to the controller, configured to receive the second scan signals from the controller;

a data driver electrically connected to the controller, configured to receive the data signals from the controller;

a plurality of scan lines electrically connected to the scan driver, each scan line configured to receive one of the second scan signals from the scan driver; and a plurality of data lines electrically connected to the data driver, each data line configured to receive one of the data signals from the data driver;

wherein the scan lines and the data lines cross over to define the plurality of pixels.

11. A controller, comprising:

a processor; and a non-volatile memory storing computer executable codes, wherein the codes, when executed at the processor, are configured to generate first scan signals for a sensing module, and send the first scan signals to the sensing module;

generate display signals for a transparent display module defining a plurality of pixels in a pixel matrix, and send the display signals to the transparent display module to control the pixels to display an image corresponding to the display signals;

receive sensing signals from the sensing module, and generate an object coordinate according to the sensing signals, wherein the sensing module is configured to detect an object at a disc jockey (DJ) side of the transparent display module in response to receiving the first scan signals, and to generate the sensing signals in response to detecting the object;

in response to an audio visual display instruction, generate the display signals corresponding to a virtual disc jockey equipment; and in response to the object coordinate matching coordinates of the virtual disc jockey equipment, generate an audio effect command for the virtual disc jockey equipment.

12. The controller as claimed in claim 11, wherein a barrier module is disposed at the DJ side of the transparent display module, wherein for a DJ at the DJ side, the barrier module is configured to allow light emitted from a first set of the pixels to be viewable only by a left eye of the DJ, and allow light emitted from a second set of the pixels to be viewable only by a right eye of the DJ, such that the DJ perceives the light emitted from the first set of the pixels as a left-eye view and the light emitted from the second set of the pixels as a right-eye view, and perceives the left-eye view and the right view to form a three-dimensional virtual image between the DJ and the transparent display module.

13. The controller as claimed in claim 12, wherein the barrier module is a parallax barrier layer, comprising a plurality of transparent units and a plurality of opaque units alternatively positioned.

14. The controller as claimed in claim 12, wherein the transparent display module is switchable between a two-dimensional display mode and a three-dimensional display mode.

15. The controller as claimed in claim 11, wherein the codes comprise:

a pixel control module configured to generate the display signals in response to a plurality of image signals, and send the display signals respectively to the display module to control the pixels;

an image processing module configured to generate the image signals from the image; and a sensing control module configured to generate the first scan signals for the sensing module, receive the sensing signals from the sensing module, and generate the object coordinate by comparing the sensing signals.

16. The controller as claimed in claim 15, wherein the sensing module comprises a plurality of capacitive sensing units in a capacitive matrix, wherein each of the capacitive sensing units is configured to receive one of the first scan signals generated by the sensing control module, to generate the sensing signals in response to the first scan signal, and to send the sensing signals to the sensing control module.

17. The controller as claimed in claim 16, wherein the capacitive sensing units are capacitive sensor electrodes, and wherein each of the capacitive sensor electrodes is configured to induce a capacitance change when the object exists within a predetermined range of the capacitive sensor electrode.

18. The controller as claimed in claim 16, wherein the capacitive sensing units are capacitive micromachined ultrasonic transducer (CMUT) arrays, and each of the CMUT arrays comprises a plurality of CMUT units, wherein each of the CMUT arrays is configured to transmit ultrasonic waves and to receive refracted ultrasonic waves by the objects.

19. A non-transitory computer readable medium storing computer executable codes, wherein the codes, when executed at a processor, are configured to generate first scan signals for a sensing module, and send the first scan signals to the sensing module;

generate display signals for a transparent display module defining a plurality of pixels in a pixel matrix, and send the display signals to the transparent display module to control the pixels to display an image corresponding to the display signals;

receive sensing signals from the sensing module, and generate an object coordinate according to the sensing signals, wherein the sensing module is configured to detect an object at a disc jockey (DJ) side of the transparent display module in response to receiving the first scan signals, and to generate the sensing signals in response to detecting the object;

in response to an audio visual display instruction, generate the display signals corresponding to a virtual disc jockey equipment; and in response to the object coordinate matching coordinates of the virtual disc jockey equipment, generate an audio effect command for the virtual disc jockey equipment.

20. The non-transitory computer readable medium as claimed in claim 19, wherein a barrier module is disposed at the DJ side of the transparent display module, wherein for a DJ at the DJ side, the barrier module is configured to allow light emitted from a first set of the pixels to be viewable only by a left eye of the DJ, and allow light emitted from a second set of the pixels to be viewable only by a right eye of the DJ, such that the DJ perceives the light emitted from the first set of the pixels as a left-eye view and the light emitted from the second set of the pixels as a right-eye view, and perceives the left-eye view and the right view to form a three-dimensional virtual image between the DJ and the transparent display module.

21. The non-transitory computer readable medium as claimed in claim 20, wherein the transparent display module is switchable between a two-dimensional display mode and a three-dimensional display mode.

22. The non-transitory computer readable medium as claimed in claim 19, wherein the codes comprise:

a pixel control module configured to generate the display signals in response to a plurality of image signals, and send the display signals respectively to the display module to control the pixels;

an image processing module configured to generate the image signals from the image; and a sensing control module configured to generate the first scan signals for the sensing module, receive the sensing signals from the sensing module, and generate the object coordinate by comparing the sensing signals.

23. The non-transitory computer readable medium as claimed in claim 22, wherein the sensing module comprises a plurality of capacitive sensing units in a capacitive matrix, wherein each of the capacitive sensing units is configured to receive one of the first scan signals generated by the sensing control module, to generate the sensing signals in response to the first scan signal, and to send the sensing signals to the sensing control module.

24. The non-transitory computer readable medium as claimed in claim 23, wherein the capacitive sensing units are capacitive sensor electrodes, and wherein each of the capacitive sensor electrodes is configured to induce a capacitance change when the object exists within a predetermined range of the capacitive sensor electrode.

25. The non-transitory computer readable medium as claimed in claim 23, wherein the capacitive sensing units are capacitive micromachined ultrasonic transducer (CMUT) arrays, and each of the CMUT arrays comprises a plurality of CMUT units, wherein each of the CMUT arrays is configured to transmit ultrasonic waves and to receive refracted ultrasonic waves by the objects.

* * * * *